US006101444A

United States Patent [19]

Stoner

[11] Patent Number: 6,101,444

[45] Date of Patent: Aug. 8, 2000

[54] NUMERICAL CONTROL UNIT FOR WELLBORE DRILLING

[76] Inventor: Michael S. Stoner, 5971 Crestone St., Golden, Colo. 80403

[21] Appl. No.: 09/138,171

[22] Filed: Aug. 21, 1998

Related U.S. Application Data

[60] Provisional application No. 60/056,460, Aug. 21, 1997.

[51] Int. Cl.[7] ..... G06F 19/00

[52] U.S. Cl. ..... 702/9

[58] Field of Search ..... 702/9; 166/255.2, 166/255.3; 367/26, 27, 45; 340/853.3, 853.4, 853.5, 853.6

[56] References Cited

U.S. PATENT DOCUMENTS

| | | | |
|---|---|---|---|
| 5,064,006 | 11/1991 | Waters et al. | 175/45 |
| 5,131,071 | 7/1992 | Tsutsumi et al. | 395/3 |
| 5,419,405 | 5/1995 | Patton | 175/27 |
| 5,598,512 | 1/1997 | Niwa | 395/61 |
| 5,678,643 | 10/1997 | Robbins et al. | 175/45 |
| 5,842,149 | 11/1998 | Harrell et al. | 702/9 |

OTHER PUBLICATIONS

Goldman, Petroleum Engineer International, Artificial Intelligence Applications Enhance Directional Control, Feb. 1993, pp. 15–22.

Patten et al., Automatic Loop Steering For Directional Drilling, PD–vol. 56, Drilling Technology—1994, pp. 47–51.

Neubert, M. and Heisig, G., "Advanced Trajectory Simulation of Directional Wellbores", pp. 45–52.

Heisig, G., Oppelt, J., Neubert, M. And Donati, F., "Closed–Loop Guided Directional Drilling Fundamentals, Concepts and Simulations" pp. 35–40.

*Primary Examiner*—Donald E. McElheny, Jr.
*Attorney, Agent, or Firm*—Sheridan Ross P.C.

[57] ABSTRACT

A numerical control unit and method is provided for determining a change in a positional setting in a downhole tool used to drill a wellbore, the numerical control unit comprising a plurality of rules in an IF . . . THEN format based on the current position of the wellbore and a preferred position of the wellbore.

26 Claims, 16 Drawing Sheets

ONLINE INPUT VARIABLES

| | | |
|---|---|---|
| 30 | dMD (ft.) | |
| TIME t-1 | TIME t | |
| 12 | 11.6 | VERTICAL DEVIATION (ft.) |
| 0 | 0 | HORIZONTAL DEVIATION (ft.) |
| -.4 | -.7 | DELTA INCLINATION (deg.) |
| 0 | 0 | DELTA AZIMUTH (deg.) |
| | | NA |
| | 0.5 | X ECCENTRICITY (mm) |
| | 0.0 | Y ECCENTRICITY (mm) |

| | | DEGREE OF MEMBERSHIP | | | | |
|---|---|---|---|---|---|---|
| 11.6 | VERD (ft.) | | | | | 1.00 |
| 0 | HORD (ft.) | | .11 | 1.00 | .11 | |
| -.7 | DPHI (deg.) | .33 | .84 | | | |
| 0 | DTHE (deg.) | | .11 | 1.00 | .11 | |
| -0.010 | DDPH (deg./md ft.) | .81 | .11 | | | |
| 0.000 | DDTH (deg./md ft.) | | .11 | 1.00 | .11 | |
| -0.013333 | DVER (ft./md ft.) | .65 | .26 | | | |
| 0.000 | DHOR (ft./md ft.) | | .11 | 1.00 | .11 | |
| 0.320 | DXEC (mm) | | .13 | .33 | | .40 |
| 0.000 | DYEC (mm) | .11 | .11 | 1.00 | .11 | .11 |
| 0.8 | X ECCENTRICITY (mm) | << SUGGESTED CHANGES | | | | |
| 0.0 | Y ECCENTRICITY (mm) | | | | | |

FIG. 14

VERTICAL DEVIATION

| RELATIVE CHANGE IN VERTICAL DEVIATION $\Delta\varepsilon_x$ | EL | VL | LO | SL | RO | SH | HI | VH | EH |
|---|---|---|---|---|---|---|---|---|---|
| NL | BH | BH | BH | BH | BH | BM | BS | BZ | LA |
| NM | BH | BH | BH | BH | BM | BS | BZ | LA | DZ |
| NS | BH | BH | BH | BM | BS | BZ | LA | DZ | DS |
| NZ | BH | BH | BM | BS | BZ | LA | DZ | DS | DM |
| ZE | BH | BM | BS | BZ | LA | DZ | DS | DM | DH |
| PZ | BM | BS | BZ | LA | DZ | DS | DM | DH | DH |
| PS | BS | BZ | LA | DZ | DS | DM | DH | DH | DH |
| PM | BZ | LA | DZ | DS | DM | DH | DH | DH | DH |
| PL | LA | DZ | DS | DM | DH | DH | DH | DH | DH |

| | |
|---|---|
| BH | BUILD HARD |
| BM | BUILD MEDIUM |
| BS | BUILD SOFT |
| BZ | BUILD ZERO |
| LA | LEAVE ALONE |
| DZ | DROP ZERO |
| DS | DROP SOFT |
| DM | DROP MEDIUM |
| DH | DROP HARD |

FIG. 16

VERTICAL DEVIATION

| INCLINATIONAL DEVIATION $Wf_x$ | EL | VL | LO | SL | RO | SH | HI | VH | EH |
|---|---|---|---|---|---|---|---|---|---|
| NL | 9 | 9 | 9 | 9 | 9 | 9 | 9 | 8/9 | 6/7 |
| NM | 9 | 9 | 9 | 9 | 9 | 9 | 8/9 | 6/7 | 4/5 |
| NS | 9 | 9 | 9 | 9 | 9 | 8/9 | 6/7 | 4/5 | 3/4 |
| NZ | 9 | 9 | 9 | 9 | 8/9 | 6/7 | 4/5 | 3/4 | 2/3 |
| ZE | 1/2 | 2/3 | 3/4 | 4/5 | 9 | 4/5 | 3/4 | 2/3 | 1/2 |
| PZ | 2/3 | 3/4 | 4/5 | 6/7 | 8/9 | 9 | 9 | 9 | 9 |
| PS | 3/4 | 4/5 | 6/7 | 8/9 | 9 | 9 | 9 | 9 | 9 |
| PM | 4/5 | 6/7 | 8/9 | 9 | 9 | 9 | 9 | 9 | 9 |
| PL | 6/7 | 8/9 | 9 | 9 | 9 | 9 | 9 | 9 | 9 |

1=>WF=10%
2=>WF=20%
3=>WF=30%
4=>WF=40%
5=>WF=50%
6=>WF=60%
7=>WF=70%
8=>WF=80%
9=>WF=90%

FIG. 17

NUMERICAL CONTROL UNIT FOR WELLBORE DRILLING

This application claims priority of U.S. Provisional Patent Application Ser. No. 60/056,460, having a filing date of Aug. 21, 1997, and is incorporated herein by reference in its entirety.

FIELD OF THE INVENTION

The present invention relates to an apparatus and method adapted for controlling the positional settings of a downhole tool based on a plurality of rules in an IF . . . THEN format which are related to the current position of a wellbore and a preferred position of the wellbore.

BACKGROUND OF THE INVENTION

Directional drilling describes a commonly used technique for drilling a non-linear wellbore. This type of wellbore is generally characterized by a bottomhole location which is not directly below the surface location of the wellbore, and numerous variations and geometric shapes may be utilized. Directional drilling technology is highly utilized in the production of oil and gas, especially in offshore environments where multiple wells are drilled from one central surface location such as an offshore platform. This technology is extremely cost effective since multiple wellbores can be drilled from one central structure as opposed to constructing platforms for each individual wellbore. Further applications include drilling below populated urban areas, mountainous terrain and other locations where it is either impractical or economically unfeasible to have a surface location directly above a bottomhole location.

Due to the ever increasing difficulty in finding new oil and gas reserves, directional drilling provides a means for oil and gas producers to exploit these energy resources in downhole locations previously unobtainable. However, with increasingly difficult subsurface locations, it is critical that accurate measurements and controls be utilized to properly steer the direction of the wellbore during drilling, especially with increasingly complicated wellbore geometric shapes. Thus, it is increasingly important to oil and gas producing companies to be able to accurately control the directional drilling of a wellbore to accurately reach a target bottomhole location. Further, properly designed and drilled wellbores may eliminate or severely reduce unwanted doglegs and other problematic wellbore configurations that can become troublesome during the completion of the well.

The drilling of a non-vertical, deviated wellbore requires frequent measurement of the downhole location of the drill bit and or other hardware typically referred to as the "bottomhole assembly". The bottomhole assembly may include adjustable stabilizers and various other tools which may be adjusted during the drilling of the well to steer or otherwise orient the direction the well will be drilled.

The current position of the bottomhole assembly is generally determined with measurement while drilling (hereinafter "MWD".) equipment. This equipment allows critical information to be transmitted to the surface location at periodic time or depth intervals, and is used to calculate the coordinates of the current position of the bottomhole assembly. This information is then compared to previous positions of the bottomhole assembly by graphically plotting the actual wellbore path in comparison and to the preferred or projected drilling plan. The preferred drilling plan provides a blueprint of the optimum wellbore path. Based on this information, the present method used to directionally drill a wellbore requires a directional drilling engineer or technical consultant (hereinafter "directional driller") to make adjustments to the position of one or more tools used in the bottomhole assembly to properly steer the direction of the bottomhole assembly and thus the wellbore. Wellbore information which is most commonly used by the directional driller includes only horizontal and vertical deviations as plotted on sectional and plan views and compared to the preferred wellbore path. Modifications to the drillstring bottomhole assembly are then subjectively made based on prior experience.

The limitations of the present method for drilling a directionally deviated wellbore are directly related to human skill and the unavoidable variabilities thereof and the costs related therein. For example, directional drillers have different degrees of education, on site training and expertise, and there is little consistency between any two drillers and their thought processes for accurately making decisions to control the path of the wellbore. Additionally, decisions are commonly made during periods of sleep deprivation which inherently make the decision making process susceptible due to errors in judgment. Further, the necessity of having an onsite directional driller on location, in addition to the rig driller, is expensive just based on their salary. Thus, very costly errors are often made which result in downtime on a drilling rig, the sidetracking of a well due to severe deviations in the wellbore path, and/or the necessity for drilling an entirely new wellbore. Thus, there is a significant need for an automated, numeric control system which can accurately and automatically interpret substantial volumes of data related to an existing position of a wellbore and a preferred wellbore path and make specific corrections to the position of a downhole tool assembly. These corrections in the downhole tool assembly are then used to steer the bottomhole assembly and resultant wellbore path to a desired location while eliminating the substantial risk of human error.

Thus, a significant need exists to provide a numerical control unit for wellbore drilling which can process substantial amounts of constantly changing data related to the current position of a wellbore and a preferred position of a wellbore. This information may then be used to accurately dictate the required change in the positional settings of a downhole adjustable tool to properly steer a bottomhole assembly to a desired target location. Reliable, automated directional drilling of the future unquestionably requires such.

SUMMARY OF THE INVENTION

It is thus an object of the present invention to provide a computer numerical control unit (hereinafter "NCU") which can interpret current wellbore positional data and preferred wellbore path data and provide output data regarding changes in the positional settings of a downhole tool. The tool settings and resultant position of the downhole tool assembly is subsequently used to steer the bottomhole assembly during the drilling of a directionally drilled wellbore to a preferred target bottomhole location. As used herein, a directionally drilled wellbore is defined as any non-linear, non-vertical wellbore which has planned horizontal displacements between the surface location and the bottomhole location.

It is a further object of the present invention to provide a plurality of rules in an IF . . . THEN format which can interpret both lineal and angular input data of a current wellbore position in relation to a preferred wellbore position and provide an output for changing a position of a downhole tool.

As discussed herein, when the terms wellbore position, or bottomhole assembly, or wellbore bottomhole position are discussed it is meant to encompass a current position proximate to the current bottomhole location of the wellbore. Depending on the type of equipment in use during the drilling of the wellbore, and/or the chosen survey calculational method used to calculate the coordinates of the wellbore at different depths, there may be slight variations in the calculated positions of the bottomhole assembly, the downhole adjustable drilling tool or stabilizer, and the bottomhole location of the wellbore. However, these variations may easily be calculated when comparing the current depth to the preferred wellbore path at that particular location, and thus are not critical distinctions for the purpose of defining the present invention.

Thus in one aspect of the present invention a numerical control unit is provided and adapted for determining the change in positional settings of a downhole tool used for steering a bottomhole assembly to drill a wellbore. The numerical control unit in one embodiment comprises:

a knowledge storage section having a first plurality of rules in an IF . . . THEN format, with said rules based on differences between a current position proximate to a bottomhole location of the wellbore and a preferred position of the wellbore; and an inferring section for determining the desired new changes to the positional settings of the downhole tool on the basis said first plurality of rules stored in the knowledge storage section.

In a preferred embodiment, the first plurality of rules are based on mathematical differences of spatial properties between a current position of a location proximate to the bottomhole location and a preferred position of the bottomhole location based on a planned wellbore path. Preferably, the mathematical differences of spatial properties in the first plurality of rules includes input comprised of linear deviation components and/or angular deviation components calculated from the aforementioned current position of the wellbore bottomhole and a preferred position of the wellbore bottomhole, and past values of the same.

In another aspect of the present invention, a method adapted for controlling the tool settings of a downhole tool position to steer a bottomhole assembly used for the drilling of a wellbore is provided. This method preferably comprises the steps of;

storing a first plurality of rules in an IF . . . THEN format in a knowledge storage section, said first plurality of rules defining a degree of movement for the settings of the downhole tool to change the position of the downhole tool based on a current measured position proximate to the bottomhole of the wellbore and a current preferred position of the bottomhole of the wellbore;

receiving current wellbore position data which defines the current position of the wellbore proximate to the bottomhole location and determining the deviations therein;

inferring the current wellbore positional data with the first plurality of rules to determine a preferred setting of the adjustable downhole tool to provide steering of the bottomhole assembly.

Preferably, the aforementioned method comprises the additional step of providing output means to either automatically make changes in the downhole tool settings or to provide some form of visual output display which indicates the correct tool settings on predetermined depth intervals. Further, it is preferred that the first plurality of rules be based on mathematical differences of spatial properties between a current position proximate to a wellbore bottomhole position and a current preferred position of the wellbore bottomhole location. The spatial properties in one embodiment include input data comprised of linear deviation components and/or angular deviation components based on the current position of the wellbore bottomhole location (or proximate thereto) and the current desired wellbore bottomhole location as determined from a directional drilling plan.

BRIEF DESCRIPTION OF THE DRAWINGS

FIG. 14 is a depiction of one example of a computer screen identifying the numerical control unit software input and output.

FIG. 16 is a graphical depiction of a rule matrix identifying $E_x$ as a function of vertical deviation and relative change in vertical deviation;

FIG. 17 is a graphical depiction of a 9×9 rule matrix used to determine weighting factor $WF_x$ as a function of vertical deviation and inclinational deviation;

DESCRIPTION OF THE PREFERRED EMBODIMENTS

Figure 1:
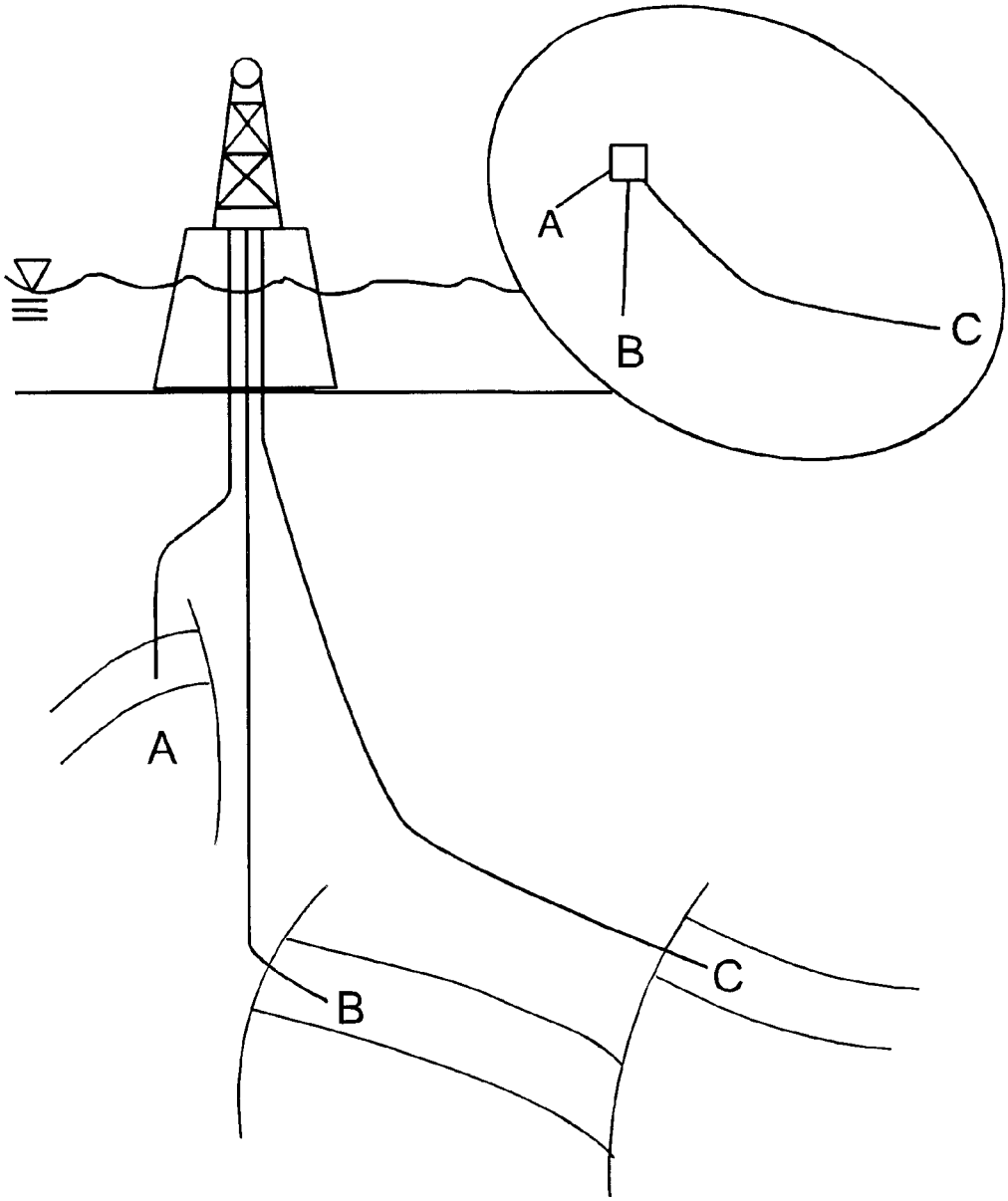
FIG. 1. is a depiction of an offshore drilling platform identifying three different directional wellbores drilled from a common offshore platform.

Referring now to the drawings, FIG. 1 depicts a typical offshore drilling structure showing a platform anchored to the ocean floor and three distinct directional wellbores drilled into three different locations via three different paths. As seen in the drawing, all three wellbores have effectively the same common surface location at the platform, yet have significantly different bottomhole locations. The ability to utilize the same platform structure to drill numerous downhole locations is a significant cost benefit to the offshore operator. However, the success of this type of offshore facility is highly dependent on the ability of the offshore operator to successful control the wellbore path of the various wellbores to assure penetration in selected pay zones. As discussed hereinbelow, the present invention provides a numerical control unit apparatus and a method for steering a directionally drilled wellbore based on the current position of the wellbore and a preferred position of a wellbore by means of utilizing a downhole tool such as an adjustable stabilizer.

Figure 2:
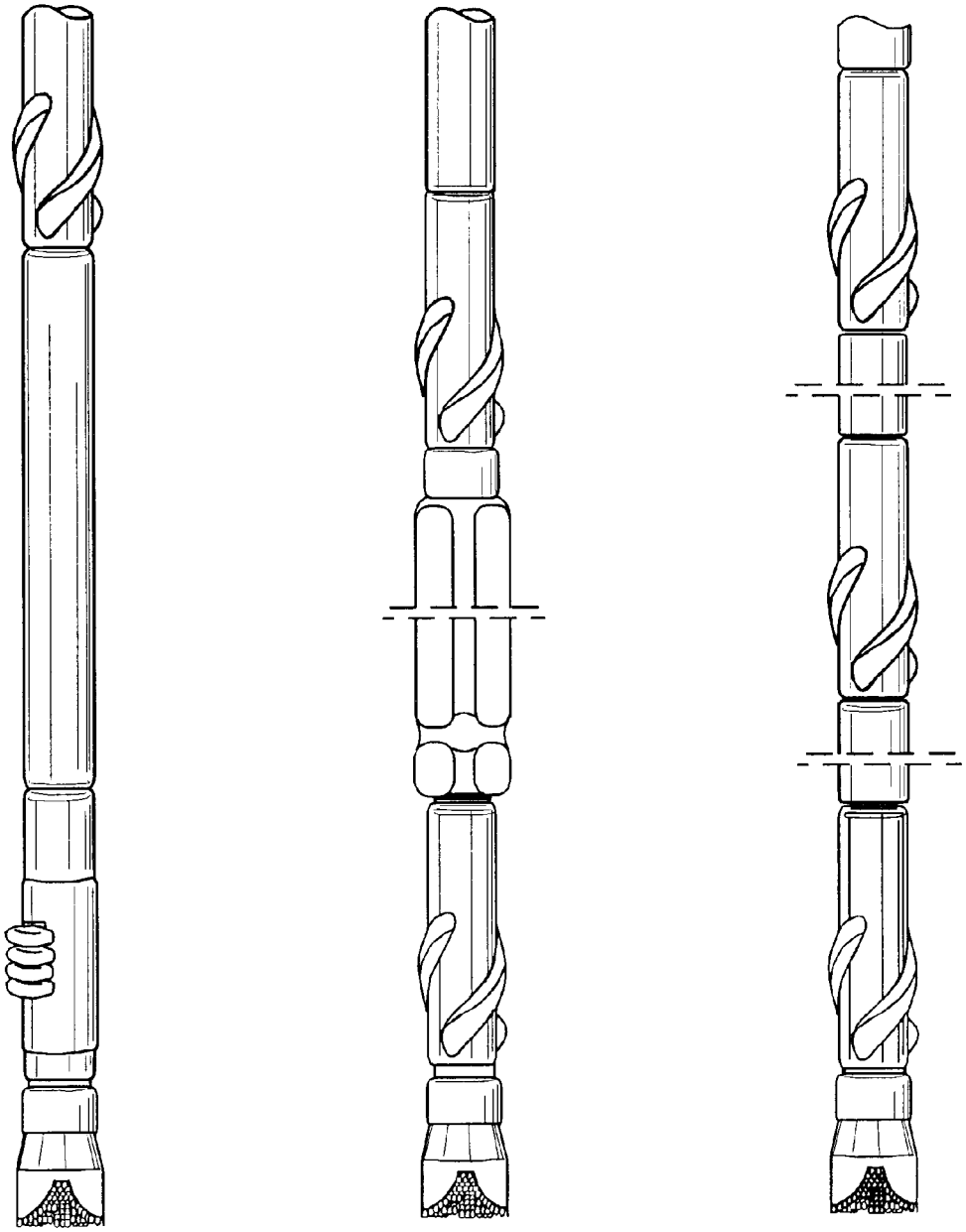
FIG. 2 is a drawing identifying numerous variations of bottomhole assemblies used to drill a wellbore, and more specifically directionally drilled wellbores.

Referring now to FIG. 2, numerous variations of bottomhole assemblies used in the drilling of wellbores is provided for reference purposes. These bottomhole assemblies are generally characterized by a downhole drill bit which is interconnected to one or more types of stabilizers and drill collars. Typically, the stabilizers and drill collars are used in various combinations determined by the directional drilling engineer to change the degree of stiffness of the bottomhole assembly, which in turn influences the direction of the wellbore during drilling. Although there are endless variations of bottomhole assemblies, for clarity purposes the present invention may be used in association with any bottomhole assembly or tool configuration which utilizes at least one adjustable tool which can be modified as necessary to change the forces acting on that particular tool and/or the bottomhole assembly.

One example system comprising an adjustable downhole tool is produced and sold by Baker-Hughes Inteq under the brand name of "Autotrak". The Autotrak system contains a non-rotating, expandable stabilizer located near the drill bit.

Figure 3:
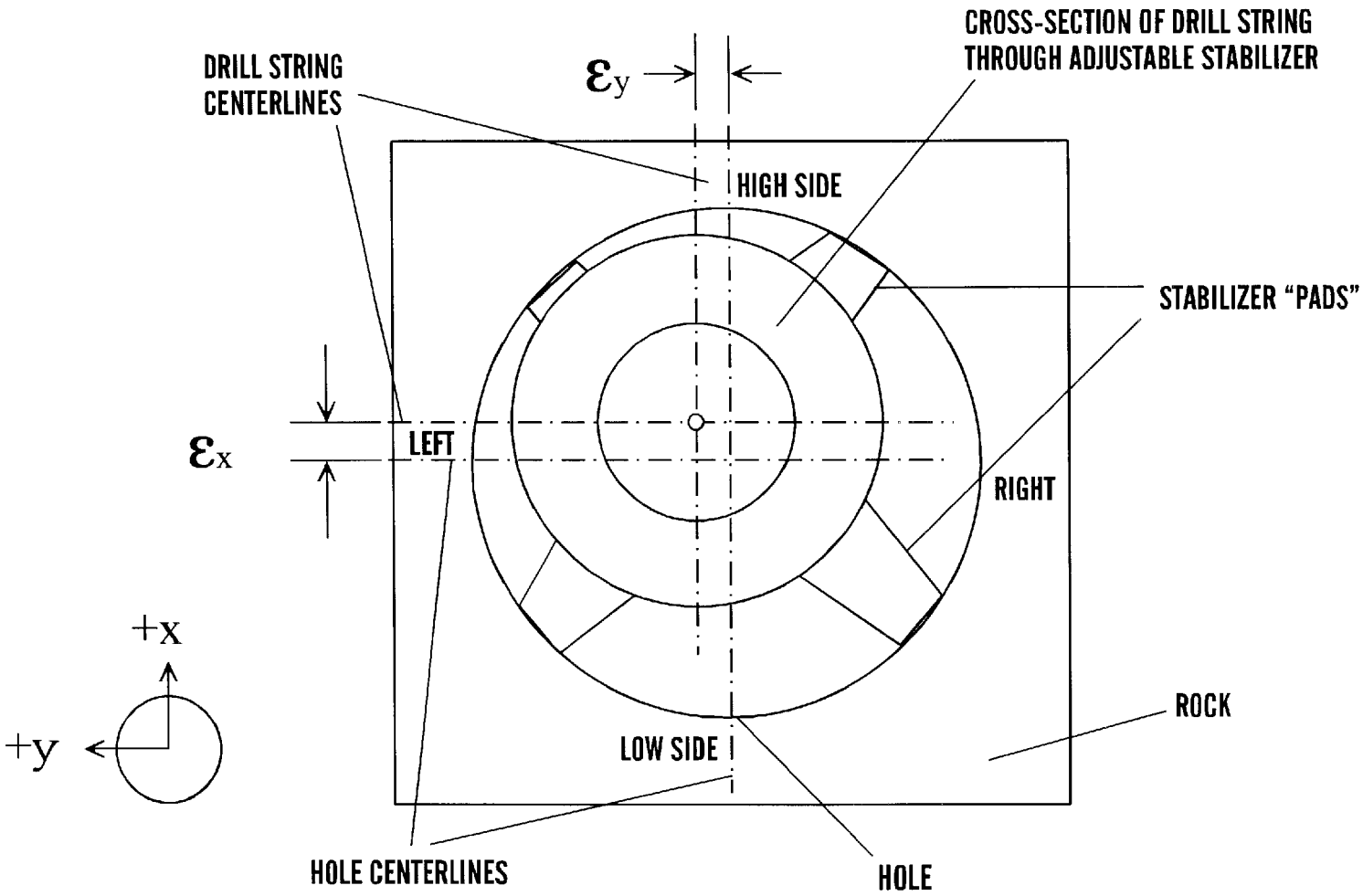
FIG. 3 is a cross-section of an adjustable stabilizer used to change the position of a bottomhole assembly and subsequently determine a wellbore path.

A cross section of one type of adjustable stabilizer tool positioned in a wellbore is shown in FIG. 3. As depicted in FIG. 3, the tool utilizes stabilizer "pads" which position the stabilizer tool in a preferred position in the wellbore. Additionally, the tool may be adjusted along an X and Y axis based on an $E_x$ eccentricity setting and an $E_y$ eccentricity setting to change the position of the tool in the wellbore. These changes in the position of the adjustable stabilizer effectively change the side-forces acting on the tool and the bottomhole assembly, thus allowing the bottomhole assembly to be "steered" in a preferred direction based on a predetermined well plan.

The term "fuzzy" as used herein may generally be defined as the degree or quality of imprecision intrinsic in a property, process, or concept. The measure of the fuzziness and its characteristic behavior within the domain of the process is the semantic attribute captured by a fuzzy set. Fuzziness is not ambiguity nor is it the condition of partial or total ignorance; rather, fuzziness deals with the natural imprecision associated with everday events. When we measure temperature against the notion of hot, or height against the notion of tall, of speed against the notion of fast, we are dealing with imprecise concepts. There is no sharp boundary at which a metal is precisely cold, then precisely cool, then precisely warm, and finally, precisely hot. Each state transition occurs continuously and gradually, so that, at some given measurement, a metal rod may have some properties of warm as well as hot.

The term "fuzzy set" differs from the conventional or crisp set (defined by an actual, or binary set) by allowing partial or gradual memberships. A fuzzy set has three principal properties: the range of values over which the set is mapped, this is called the domain and must be monotonic real numbers in the range $[-\infty+\infty]$; the degree of membership axis that measures the value's membership in the set; and the actual surface of the fuzzy set—the points that connect the degree of membership with the underlying domain.

The fuzzy set's degree of membership value is a consequence of its intrinsic truth function. This function returns a value between [0] (not a member of the set) and [1] (a complete member of the set) depending on the evaluation of the fuzzy proposition "X is a member of a fuzzy set A." Fuzzy logic is concerned with the compatibility between a domain's value and the fuzzy concept (notion). This can be expressed as "How compatible is X with fuzzy set A?"

The present invention utilizes wellborne survey data (e.g., MWD Data) to determine the current position of the bottomhole assembly and/or various positions of the current wellbore and compares this data with a preferred position of the wellbore based on the predetermined well plan. The spatial deviations in the current and preferred positions of the wellbore are then determined, which include both linear deviation components and/or angular deviation components as discussed hereinbelow to determine the optimum position of the adjustable stabilizer utilizing a plurality of rules in an IF . . . THEN format. The adjustable stabilizer tool may then be adjusted as necessary to position the adjustable stabilizer in a manner which steers the bottomhole assembly in a preferred direction consistent with the predetermined well plan.

Accordingly, an NCU is provided. The controllable output variables of the NCU are the eccentricity settings of a non-rotating near-bit downhole adjustable stabilizer, which are determined based on a plurality of rules and measured deviations between an observed current position of a wellbore and a preferred position of the wellbore.

The identification and computations of controller inputs are mathematically detailed. The fuzzy sets of each NCU input and output are labeled for reference with notions, and the equations and parameters needed to define degree of membership functions of each fuzzy set are given. A set of 100 fuzzy control rules are presented. Three examples are given which detail the scenarios from where the respective three fuzzy rules came, as well as a discussion of the defuzzification computations. Finally, a sample calculation is presented to provide enablement to one skilled in the art.

To operate the NCU, controller input data must first be provided. This includes finding the measured depth along the planned wellbore path that minimizes the three-dimensional distance between the current bit location and the planned path. This measured depth is referred to as MD*.

The inputs to the NCU are spatial properties, i.e., they are based on lineal and angular deviations, and the changes thereof, between actual and planned drilling trajectories. The following definitions are necessary to further define the input parameters and variables related therein.

Let, $N^*_p$=North coordinate on planned path at MD*; feet $E^*_p$=East coordinate on planned path at MD *; feet $TVD^*_p$=true vertical depth coordinate on planned path at MD*, feet $\phi^*_p$=inclination of planned path at MD*; degrees $\theta^*_p$=azimuth of planned path at MD*; degrees $N_b$=North coordinate of current bottomhole location; feet $E_b$=East coordinate of current bottomhole location; feet $TVD_b$=true vertical depth coordinate of current bottomhole location; feet $\phi_b$=inclination at current bottomhole location; degrees $\theta_b$=azimuth at current bottomhole location; degrees With unit vectors $\hat{e}_1$ (North), $\hat{e}_2$ (East), and $\hat{e}_3$ (TVD), the below vector describes spatial (lineal) deviation between the bit and the plan, and the length thereof is the minimum distance between the bottomhole location and the plan.

$$\vec{D}=(N^*_p-N_b)\hat{e}_1+(E^*_p-E_b)\hat{e}_2+(TVD^*_p-TVD_b)\hat{e}_3$$

$$\vec{D}=\Delta N\hat{e}_1+\Delta E\hat{e}_2+\Delta TVD\hat{e}_3$$

Another convenient term to compute is the difference between the planned departure and the current departure as shown below.

$$\Delta DEP = DEP^*_p - DEP_b$$

$$\sqrt{(N^*_p)^2 + (E^*_p)^2} - \sqrt{N_b^2 + E_b^2}$$

Figure 4:
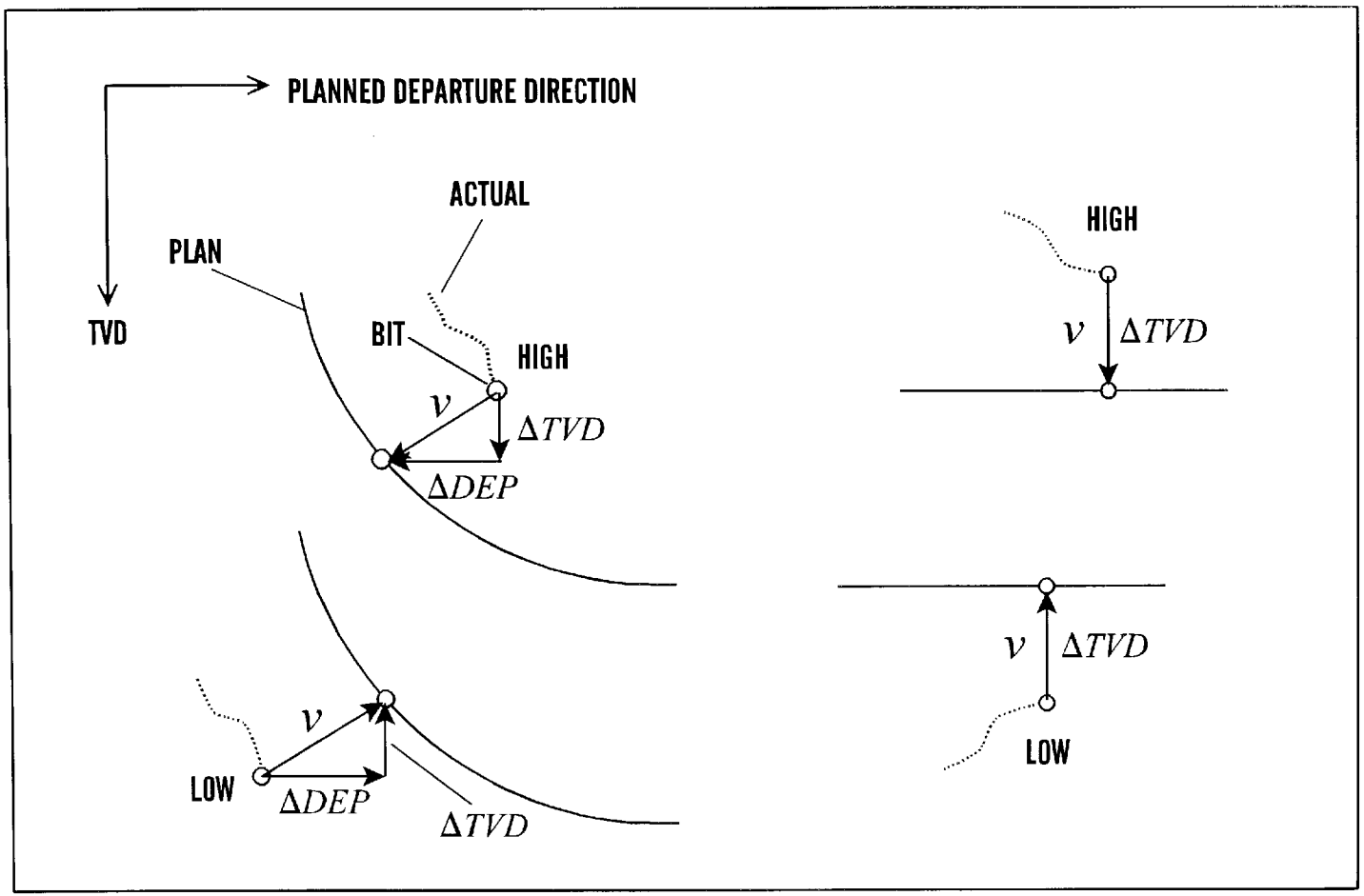
FIG. 4 is a section view of six generic views of vertical deviation between a two dimensional preferred wellbore path and actual two dimensional position of the wellbore path.
Figure 5:
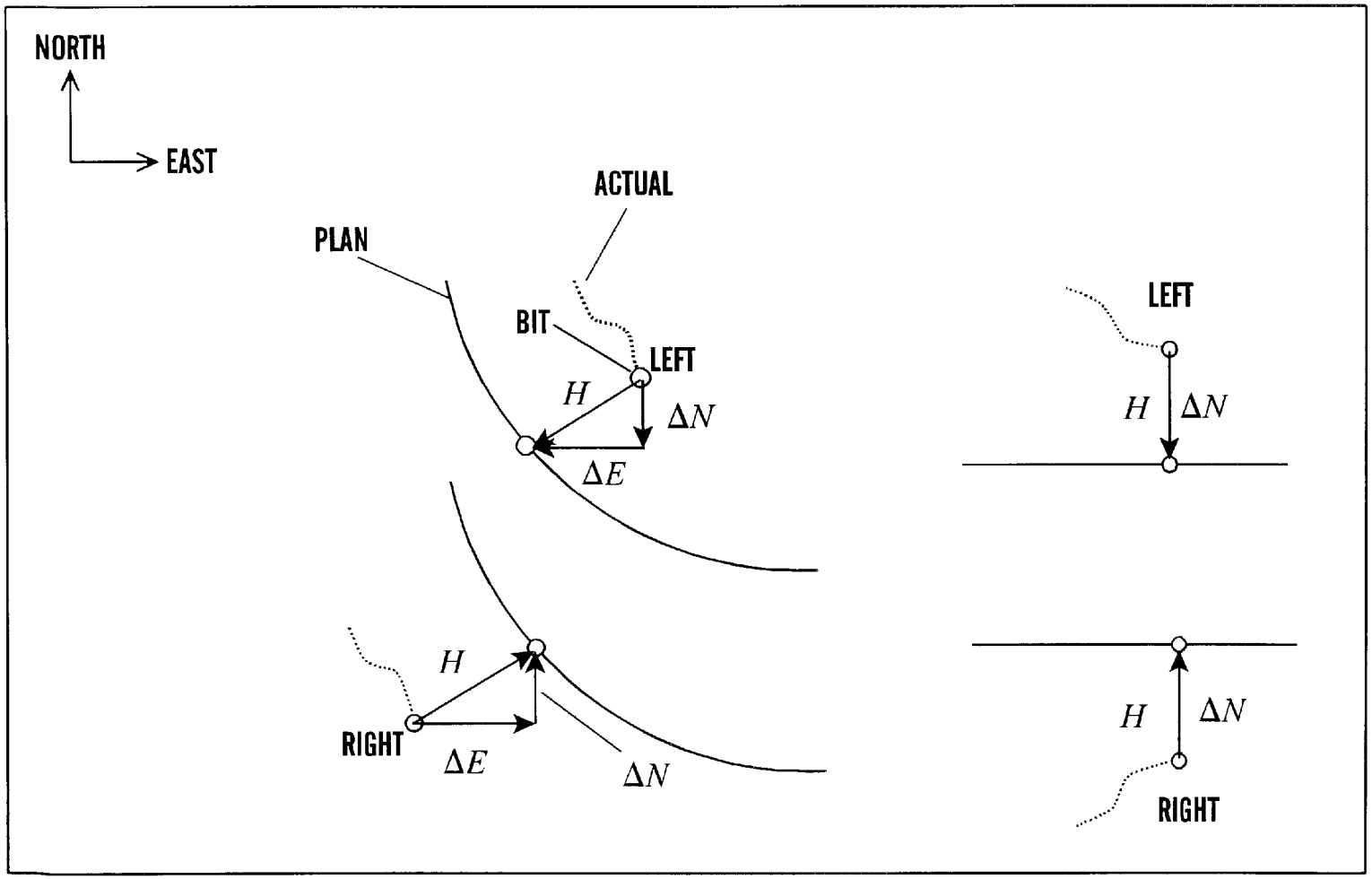
FIG. 5 is a horizontal view of four generic views of horizontal deviation between a two dimensional preferred wellbore path and a two dimensional actual position of the wellbore path.

While $\vec{D}$ and ΔDEP are not direct inputs to the NCU, they do help to explain what is presented in FIGS. 4 and 5, i.e., scenarios depicting purely two dimensional vertical deviation and horizontal deviation, respectively.

Figure 15:
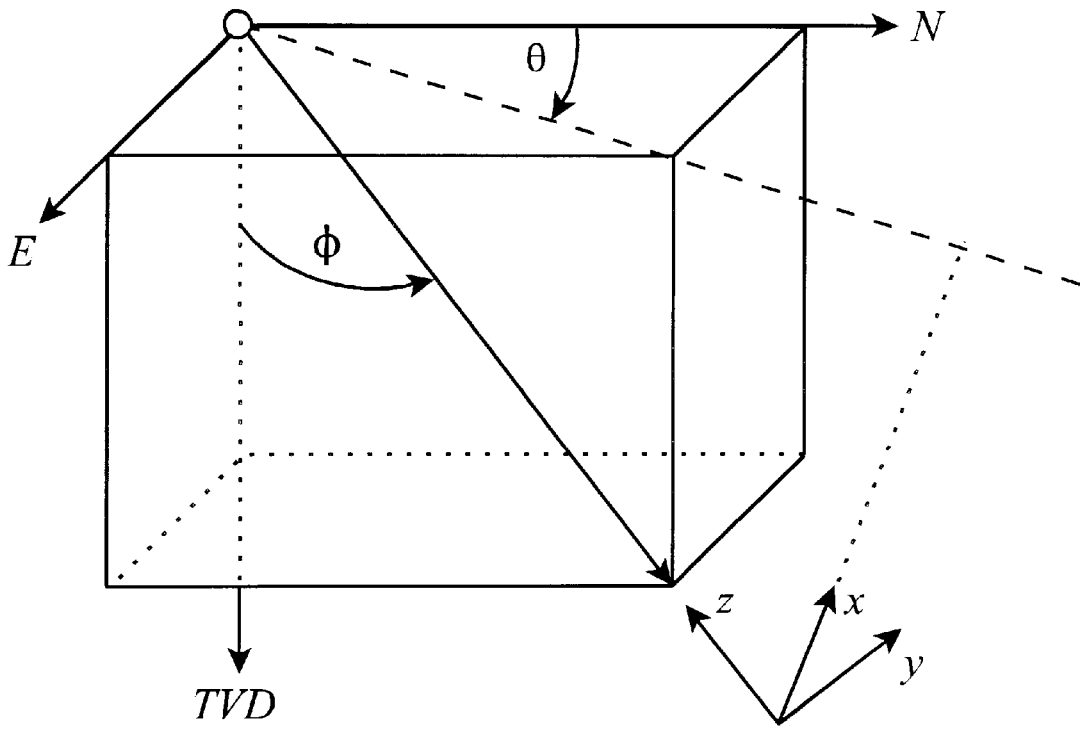
FIG. 15 is a three dimensional box diagram depicting inclination, azimuth and orientation of axes.

The following statements are made relative to the point on the plan defined by MD*, and "looking down the hole". The appropriate coordinate transformation comprising two successive rotations of axes provides a local coordinate system, whereby one axis (x-axis) points to the "high side" of the hole, and another (y-axis) lies in a horizontal plane and points to the left side of the hole The third axis points towards a vertical line beneath the wellbore surface location and whose inclination and azimuth are equivalent to those at MD*. This coordinate transformation follows the "right-hand rule". FIG. 15 depicts inclination, azimuth, and orientations of axes. With the aforementioned coordinate transformation, it is possible to compute the components of vector $\vec{D}$ such that "vertical" (i.e., high/low) and "horizontal" (i.e., left/right) deviations match intuition, because $\vec{D}$ exists in the foregoing x-y plane. Thus, vertical and horizontal deviations are linear-based.

Similarly, two angular-based deviation inputs may be computed which represent differences in wellbore angles. Inclinational deviation is the planned inclination at MD* subtracted from the current wellbore inclination. It is very possible to have zero vertical deviation and non-zero inclination deviation, and vice-versa. Azimuthal deviation is the planned azimuth at MD* subtracted from the current wellbore azimuth.

The variables that comprise the NCU input are defined as follows. Let, $$V=\cos(\theta^*_p)\cos(\phi^*_p)(N_b-N^*_p)+\sin(\theta^*_p)\cos(\phi^*_p)(E_b-E^*_p)-\sin(\phi^*)(TVD_b-TVD^*_p)$$

$$H=\cos(\theta^*_p)(E_b-E^*_p)-\sin(\theta^*_p)(N_b-N^*_p)$$

$$\Delta\phi = \phi_b - \phi^*_p$$

$$\Delta\theta = \theta_b - \theta^*_p$$

$$\Delta V_r^n = \frac{V^n - V^{n-1}}{\Delta L}$$

$$\Delta H_r^n = \frac{H^n - H^{n-1}}{\Delta L}$$

-continued $$\Delta\Delta\phi_r^n = \frac{\Delta\phi^n - \Delta\phi^{n-1}}{\Delta L}$$

$$\Delta\Delta\theta_r^n = \frac{\Delta\theta^n - \Delta\theta^{n-1}}{\Delta L}$$

where

V=vertical deviation; feet

H=horizontal deviation; feet

Δφ=inclinational deviation; degrees

Δθ=azimuthal deviation; degrees $\Delta V_r^n$=relative change in vertical deviation; feet/MD feet $\Delta H_r^n$=relative change in horizontal deviation; feet/MD feet $\Delta\Delta\phi_r^n$=relative change in inclinational deviation; degrees/MD feet $\Delta\Delta\theta_r^n$=relative change in azimuthal deviation; degrees/MD feet The superscript "n" in the definitions of each "relative change in . . . " refers to the respective values during the current processing of the NCU "n−1" means such at the prior processing of the NCU. The term ΔL refers to the distance of hole drilled in between the two foregoing NCU processings, and is also occasionally referred to as CI meaning controller intervention.

Thus, the NCU inputs are spatial properties, wherein V and H are linear-based, Δφ and Δθ are angular-based, and the other four are relative changes respectively thereof. As just defined, the NCU inputs are entirely valid as is, for any two-dimensional or three-dimensional actual path and or planned path.

Thus, we now have eight crisp (actual quantitative values) inputs to the NCU; including V, H, Δφ, Δθ, $\Delta V_r$, $\Delta H_r$, $\Delta\Delta\theta\phi_r$, and $\Delta\Delta\theta_r$. Thus, to obtain these input variables it was necessary to compute the values of control inputs based on 1) a survey of the actual hole with which to determine the Cartesian coordinates of the actual wellbore; 2) a mathematically planned hole; and 3) ΔL as discussed above. All such data are accessible in real time standard drilling operations.

It is noted that a convenient method of mathematically representing a planned wellbore trajectory is to define each Cartesian coordinate (e.g., North, East, True Vertical Depth) in parametric form. Additionally, it is preferably to represent the planned inclination angle and or azimuthal direction in parametric form. The parameter with which to do this is the path-dependent distance along the wellbore trajectory, known within the industry as "measured depth". Implementing this method allows for quick numerical determination of MD*, and thus, the foregoing five * variables. In order to map data inputs into useful outputs with the NCU, fuzzification of the inputs is first required. As a result, the domain of each NCU input must be described with chosen degrees of membership (DOM) functions, i.e., fuzzy sets. Each fuzzy set addresses a specific region of the domain of the input, and a notion with which to reference each fuzzy set is subjectively assigned. Each notion is meaning-dependent on the actual physical domain to which it is addressed. A notion is simply a word or group of words which resembles the region of the domain supported by the fuzzy set.

Consider one of the crisp NCU input variables u which belongs to the domain U. Five fuzzy sets may be chosen with which to describe U, and thus five notions ($N_1$, $N_2$, $N_3$, $N_4$, $N_5$) are required. Let the DOM functions which define the input fuzzy sets of the NCU be given as follows.

$$\mu_U^{N_1}(u) = \frac{1}{1 + \exp\left(\frac{u - (\Delta - df_1\sigma)}{sf_1\sigma}\right)} \quad \text{(asymptotic)} \qquad \text{[Eq. 1-9]}$$

$$\mu_U^{N_2}(u) = \frac{1}{1 + \left(\frac{u - (\Delta - df_2\sigma)}{sf_2\sigma}\right)^4} \quad \text{(centroidal)} \qquad \text{[Eq. 1-10]}$$

$$\mu_U^{N_3}(u) = \frac{1}{1 + \left(\frac{u - (\Delta - df_3\sigma)}{sf_3\sigma}\right)^6} \quad \text{(centroidal)} \qquad \text{[Eq. 1-11]}$$

$$\mu_U^{N_4}(u) = \frac{1}{1 + \left(\frac{u - (\Delta - df_4\sigma)}{sf_4\sigma}\right)^4} \quad \text{(centroidal)} \qquad \text{[Eq. 1-12]}$$

$$\mu_U^{N_5}(u) = \frac{1}{1 + \exp\left(\frac{-u + (\Delta + df_5\sigma)}{sf_5\sigma}\right)} \quad \text{(asymptotic)} \qquad \text{[Eq. 1-13]}$$

In the above equations are parameters which affect the shapes of the DOM functions. Within each DOM function the term ($\Delta \pm df_i\ \sigma$) affects the central tendency, and the term ($sf_i\sigma$) affects the spread. Thus, as presented, each crisp variable requires 12 parameters with which to fuzzify its applicable domain. This means 12×8=96 parameters are required to fuzzify the eight inputs. However, unlike most methodologies which require the setting of parameters, the selection of the 96 parameters is much easier than might be expected since the DOM functions are meaning-dependent on the actual physical domain. Exploiting symmetry is also rational.

The following approach was chosen for a selection of the parameters which define the fuzzy sets of the domains of each NCU input. It so happens there is justifiable reason that the domains of each crisp input vary from $-a^k$ to $a^k$, where k represents the input in question and a represents $$\frac{U_{\max}^k - U_{\min}^k}{2}.$$

Thus, Δ in [Eq. 1-9]–[Eq. 1-13] equals zero. (In a more general sense, U need not be symmetric about zero. The domain of room temperature is such an example. However, any U may be transformed to map into [−a, a], i.e., symmetric about zero.) σ was chosen to equal $$\left|\frac{a}{10}\right|.$$

The "design factors" for K inputs were set as follows.

$$df_1 = 4.0 \qquad sf_1 = 0.7 \qquad \text{[Eq. 1-14]}$$
$$df_2 = 2.5 \qquad sf_2 = 1.5$$

-continued $$df_3 = 0 \qquad sf_3 = 1.0$$
$$df_4 = df_2 = 2.5 \qquad sf_4 = sf_2 = 1.5$$
$$df_5 = df_1 = 4.0 \qquad sf_5 = sf_1 = 0.7$$

At first glance, unneeded redundancy may appear to exist in the foregoing definitions. From a "tuning" point of view, however, this is not the case. The aforementioned 96 control parameters have systematically been reduced to 13; they include $a^k$, $df_1$, $df_2$, $sf_1$, $sf_2$ and $sf_1$ (where K=8). Further reduction in control parameter dimensionality results from equating the domains of the following similar NCU inputs: V and H; Δφ and Δθ; ΔV, and $\Delta H_r$; and $\Delta\Delta\phi_r$, and $\Delta\Delta\theta_r$. Thus, there now are 9 control parameters on the input side of the NCU.

An insight may be obtained on the current discussion by relating in graphical form, [Eq. 1-9]–[Eq. 1-14] to the eight NCU inputs. First, however, the notions $$(N_1^k, N_2^k, N_3^k, N_4^k, N_5^k)$$

need to be defined. In reference to monotonically increasing values of $u^k$, the chosen notions for each input are presented below.

V: Very Low (VL), Low (LO), Right On (RO), High (HI), Very High (VH)

H: Far Left (FL), Left (LE), Right On (RO), Right (RI), Far Right (FR)

Δφ: Negative Big (NB), Negative Small (NS), Zero (ZE), Positive Small (PS), Positive Big (PB)

Δθ: NB,NS,ZE,PS,PB $\Delta V_r$: NB,NS,ZE,PS,PB $\Delta H_r$: NB,NS,ZE,PS,PB $\Delta\Delta\phi_r$: NB,NS,ZE,PS,PB $\Delta\Delta\theta_r$: NB,NS,ZE,PS,PB Screen captures from the NCU software coded by the inventor are presented in FIG. 6–FIG. 9. The fuzzy sets and domains of the NCU inputs are displayed for reference purposes.

The next step in operating the NCU entails the fuzzification of the crisp NCU outputs. Thus, before advancing to the next step of the controller computations (which is rule-firing), the NCU output domains need to be fuzzified. The NCU outputs (controllables) are relative changes to the eccentricity settings of the adjustable stabilizer, namely $\Delta\epsilon_x$ and $\Delta\epsilon_y$. The unit of the outputs is millimeter. Although as appreciated by one skilled in the art any other output scale such as inches or micrometers may be used.

Furthermore, the outputs need not be eccentricity translations, but could be tool forces in an x-direction and or y-direction. Simulations showed that each 0.1 mm in eccentricity is equivalent to about 200 lbs. force. There are many similarities between the fuzzification of inputs and the fuzzification of outputs, however, modifications to the DOM functions and the values of the design factors were imposed.

Consider a crisp NCU output y which belongs to the domain Y. Five fuzzy sets may be chosen with which to describe Y, and thus five notions ($N_1$, $N_2$, $N_3$, $N_4$, $N_5$) are required. Let the DOM functions which define the NCU output fuzzy sets be given as follows.

$$\mu_Y^{N_1}(y) = \frac{1}{1 + \exp\left(\frac{y - (\Delta - df_1\sigma)}{sf_1\sigma}\right)} \quad \text{(asymptotic)} \qquad \text{[Eq. 1-15]}$$

$$\mu_Y^{N_2}(y) = \frac{1}{1 + \left(\frac{y - (\Delta - df_2\sigma)}{sf_2\sigma}\right)^2} \quad \text{(centroidal)} \qquad \text{[Eq. 1-16]}$$

$$\mu_Y^{N_3}(y) = \frac{1}{1 + \left(\frac{y - (\Delta - df_3\sigma)}{sf_3\sigma}\right)^2} \quad \text{(centroidal)} \qquad \text{[Eq. 1-17]}$$

$$\mu_Y^{N_4}(y) = \frac{1}{1 + \left(\frac{y - (\Delta - df_4\sigma)}{sf_4\sigma}\right)^4} \quad \text{(centroidal)} \qquad \text{[Eq. 1-18]}$$

$$\mu_Y^{N_5}(y) = \frac{1}{1 + \exp\left(\frac{-y + (\Delta + df_5\sigma)}{sf_5\sigma}\right)} \quad \text{(asymptotic)} \qquad \text{[Eq. 1-19]}$$

Thus, $\Delta E_x$ and $\Delta E_y$ could be replaced by $\Delta F_x$ and $\Delta F_y$, respectively, and the domain (in conjunction with the example domain present herein) would be changed to ±2,000 lbs. force.

This concept is technically trivial, however, in relation to a physical tool, it is likely that the tool positioned settings are force-controlled via hydraulic pressure-area means, and not "length-controlled". This concept does not alter the design or interworkings of the NCU. Tool settings in terms of eccentricity translations were chosen herein for simplifying the mathematical modeling of the directional drilling process. The foregoing functions were subjectively chosen because of the function shapes they produce, and because of their integration characteristics. The design factors of the DOM functions for the NCU outputs $\Delta\epsilon_x$ and $\Delta\epsilon_y$ were chosen as follows.

$$\begin{aligned} df_1 &= 6.5 & sf_1 &= 0.8 \\ df_2 &= 3.8 & sf_2 &= 1.2 \\ df_3 &= 0 & sf_3 &= 1.2 \\ df_4 &= df_2 = 3.8 & sf_4 &= sf_2 = 1.2 \\ df_5 &= df_1 = 6.5 & sf_5 &= sf_1 = 0.8 \end{aligned} \qquad \text{[Eq. 1-20]}$$

In reference to monotonically increasing values of $\Delta\epsilon_x$ and $\Delta\epsilon_y$, the chosen notions for each output are presented below. In lay terms the notions reflect the rule-of-thumb effects of changing the eccentricity settings.

$\Delta\epsilon_x$: Drop Hard (DH), Drop Soft (DS), Leave Alone (LA), Build Soft (BS), Build Hard (BH)

$\Delta\epsilon_y$: Right Hard (RH), Right Soft (RS), Leave Alone (LA), Left Soft (LS), Left Hard (LH)

Figure 6:
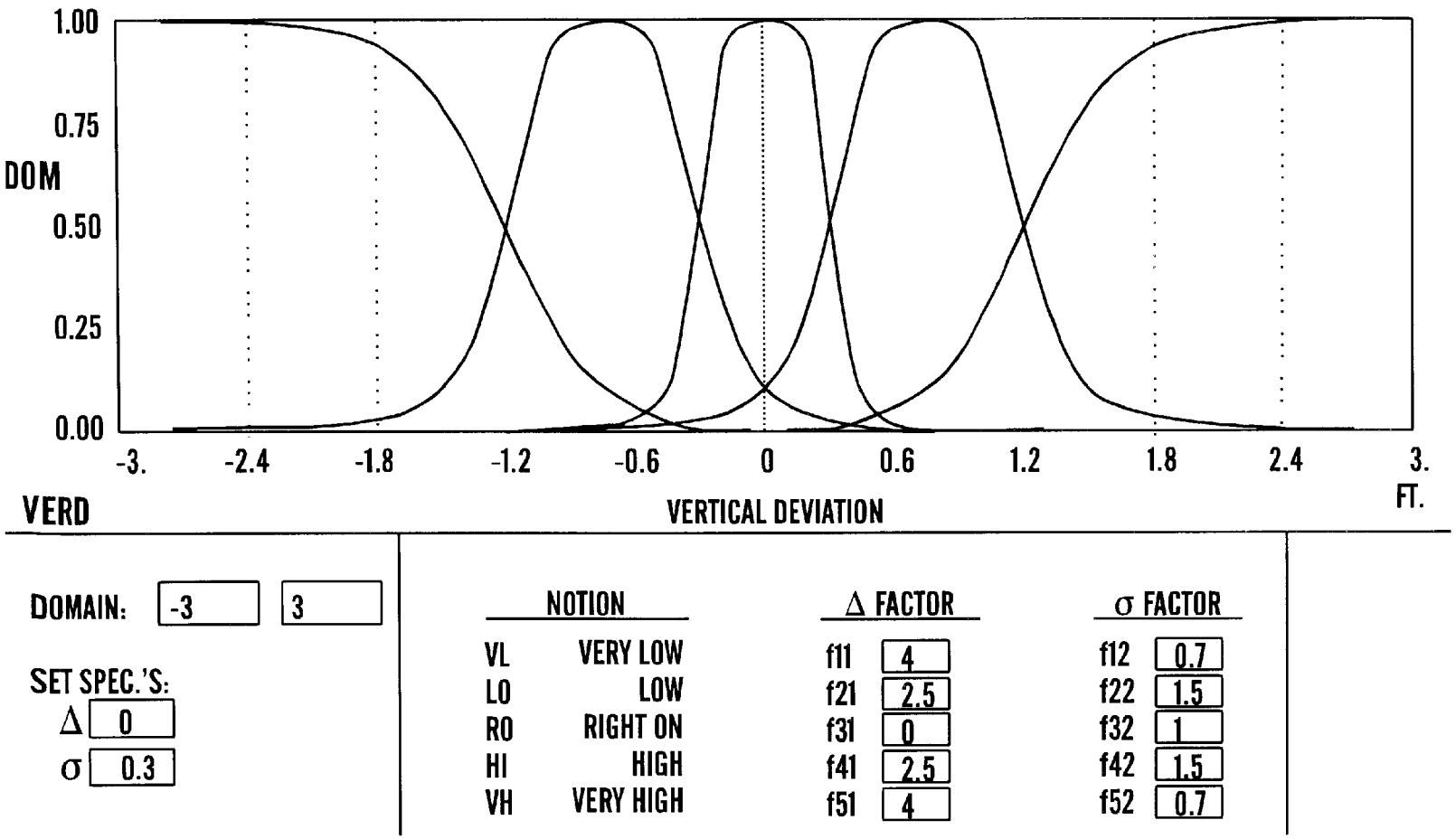
FIG. 6 is a depiction of fuzzy sets and an example domain of vertical deviation.
Figure 7:
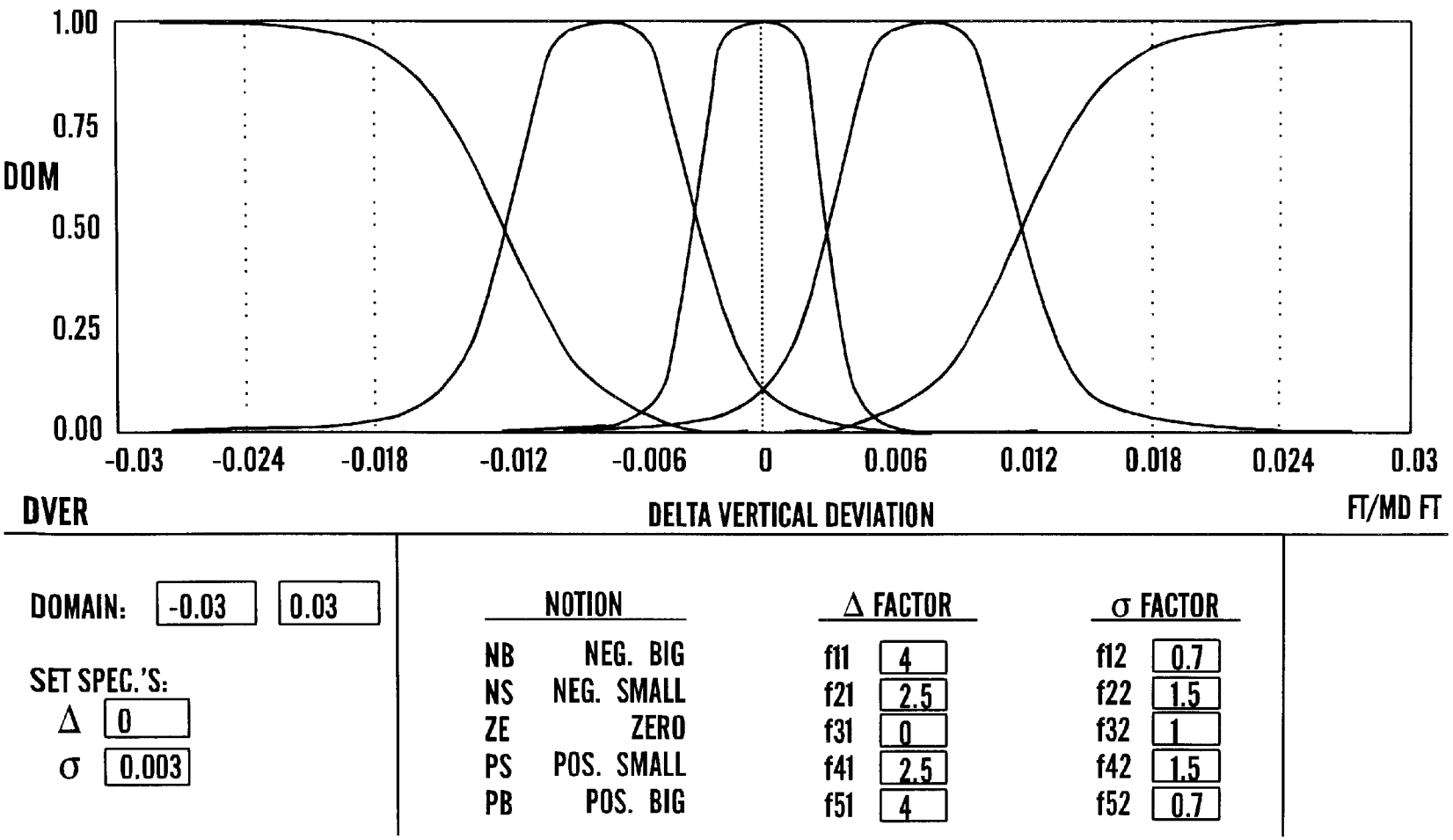
FIG. 7 is a depiction of fuzzy sets and an example domain of relative change in vertical deviation.
Figure 8:
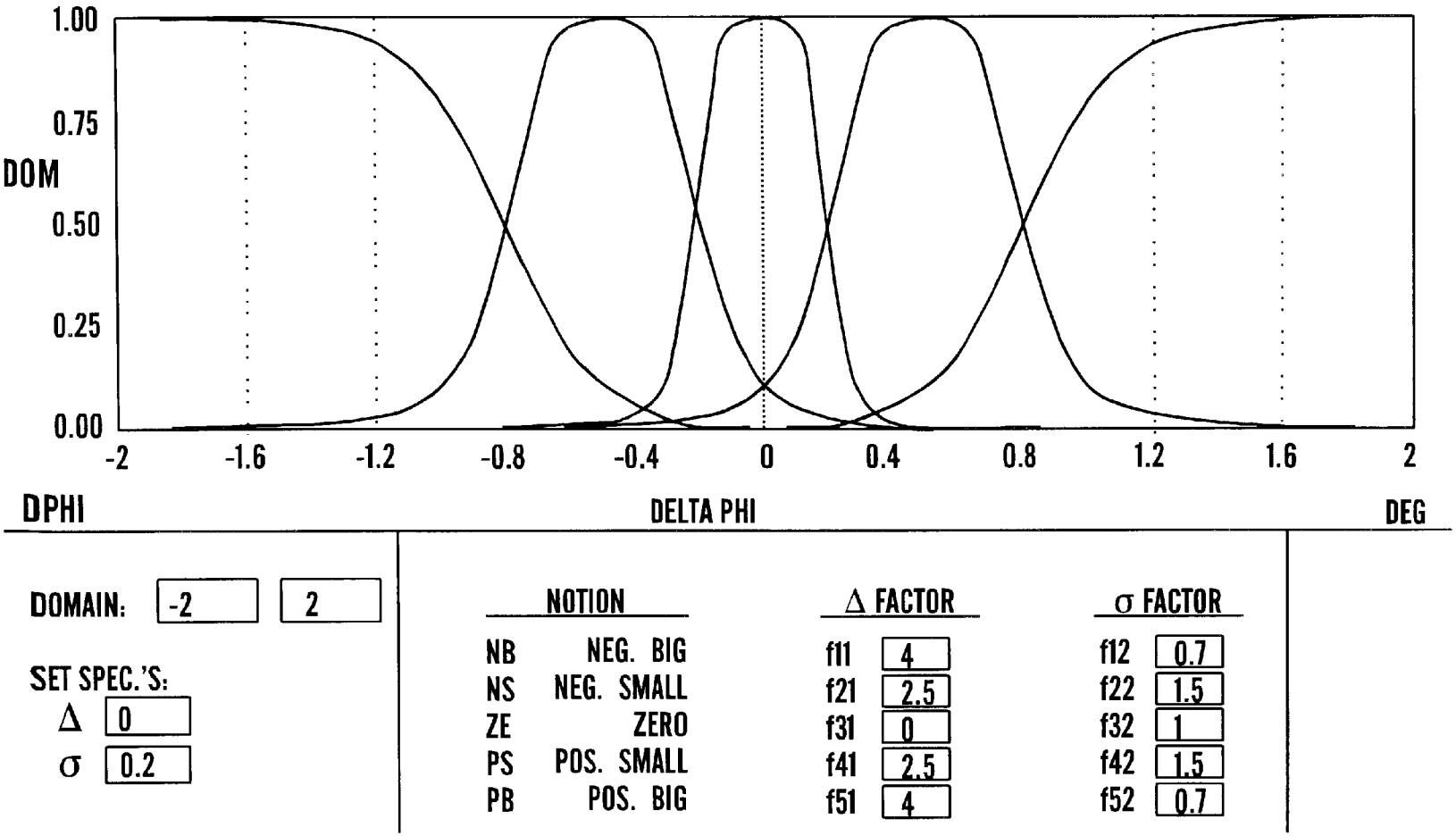
FIG. 8 is a depiction of fuzzy sets and an example domain of inclinational deviation.
Figure 9:
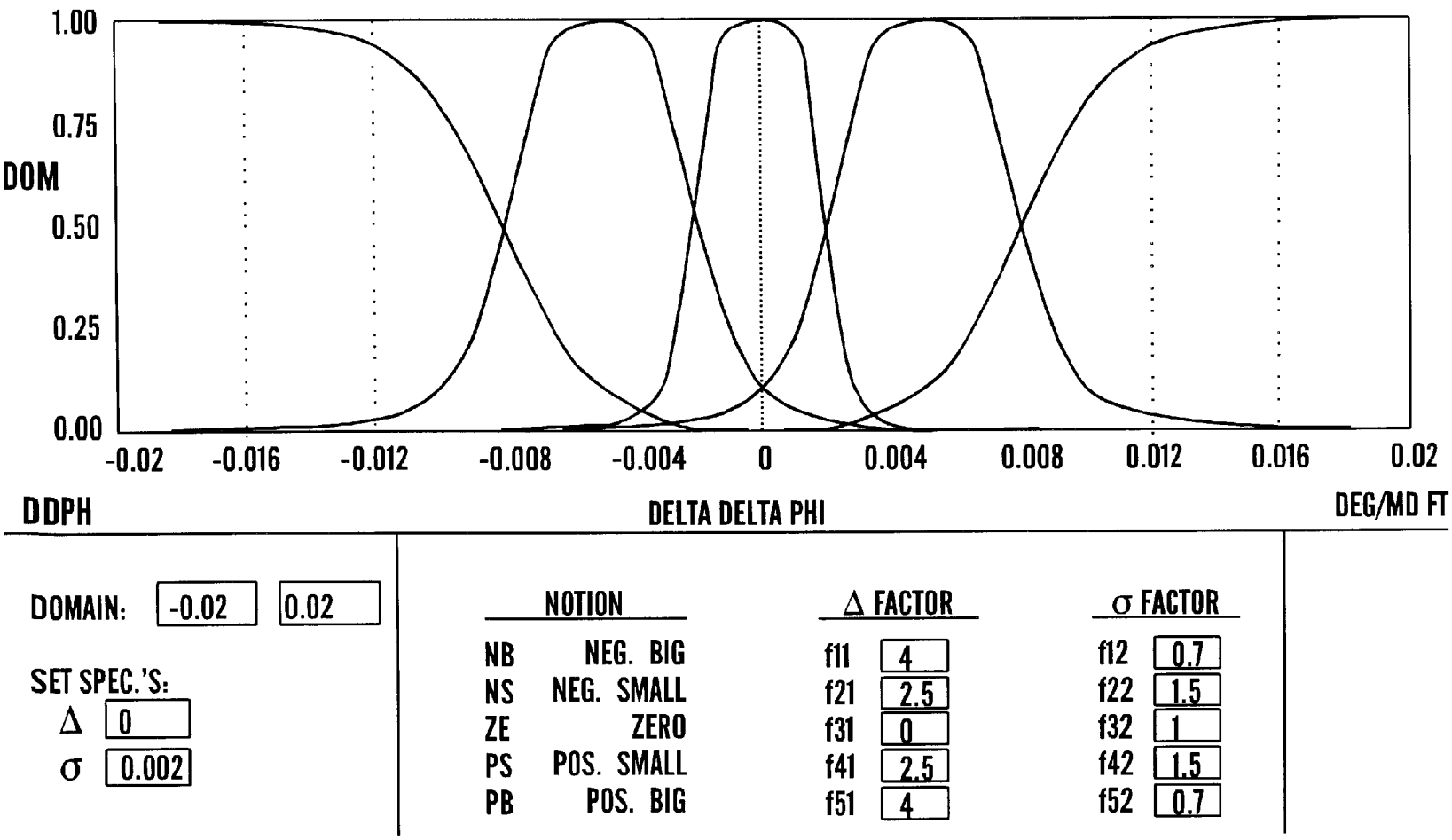
FIG. 9 is a depiction of fuzzy sets and an example domain of relative change in inclinational deviation.
Figure 10:
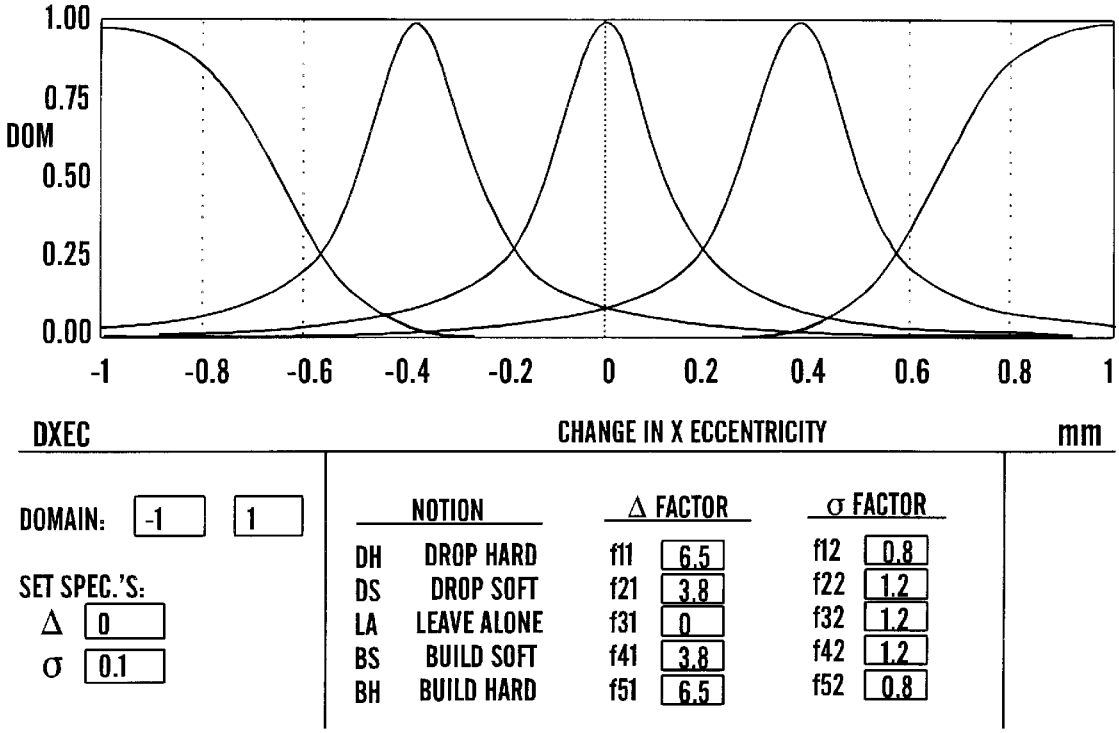
FIG. 10 is a depiction of fuzzy sets and an example domain of change in the settings of x-eccentricity of an adjustable downhole tool.

A screen capture from the NCU software may be seen in FIG. 6–7, where the fuzzy sets and domains of the NCU outputs are displayed.

The NCU rules must be identified. The NCU rules mimic a similar structure of a classical proportional-differential (PD) controller, in that "errors" and "error rates" are grouped. Conceptually, the NCU inputs were assembled and related to outputs in Table 6–8 shown below, which indicates input/output grouping and a conceptual view of mapping the NCU inputs into outputs.

TABLE 6-8

Input-output grouping, and conceptual view of mapping directional drilling controller inputs into outputs.

$$\left.\begin{array}{l} \left.\begin{array}{l} 1)\ V \\ 2)\ \Delta V_r \end{array}\right\} \text{lineal} \Rightarrow \\ \left.\begin{array}{l} 3)\ \Delta\phi \\ 4)\ \Delta\Delta\phi_r \end{array}\right\} \text{angular} \Rightarrow \end{array}\right\} \Rightarrow 1)\ \Delta\varepsilon_x \qquad \left.\begin{array}{l} \left.\begin{array}{l} 5)\ H \\ 6)\ \Delta H_r \end{array}\right\} \text{lineal} \Rightarrow \\ \left.\begin{array}{l} 7)\ \Delta\theta \\ 8)\ \Delta\Delta\theta_r \end{array}\right\} \text{angular} \Rightarrow \end{array}\right\} \Rightarrow 2)\ \Delta\varepsilon_y$$

The selection of fuzzy controller inputs and controller parameters, and the entire process of rule specification is not necessarily something which may be mathematically derived. (What was just stated regarding the selection of controller inputs and controller parameters is also relevant within classical control theory.) The design of a NCU controller which utilizes fuzzy logic comes from an understanding of the physical problem and how it relates to fuzzy logic control theory. The cognition of a complex physical system does not-with a sustainable reflection to reality-always lend itself to be fully described with mathematics and physics.

Changing the eccentricity of the near-bit adjustable stabilizer influences the forces acting on the bit. The forces on the bit influence the direction in which the hole is drilled. With reference to a bit-fixed coordinate system, (where +x is towards the high side of the hole, +y is towards the left side of the hole, and x=y=0 is at the center of the hole) increasing the value of $\epsilon_x$ tends to eventually force the bit to drill up. This means that the inclination tends to increase, hence the directional drilling term "build" (angle). Decreasing the value of $\epsilon_x$ eventually tends to force the bit to drill down, hence the term "drop" (angle). Direct similarities exist with the bit forces in the y direction and those in the x direction. Bit forces in the y direction may be influenced with $\epsilon_y$, thereby affecting the bit to drill a hole which turns left or turns right.

Each sub-grouping of inputs to outputs has the same rule matrix (RM) 10 structure. Shown below in Table 6–9, Table 6–10 and Table 6–11 are various rule matrices used in the NCU. The left superscript (m,n) signifies the inputs and the left subscript (k) signifies the output, where V, $\Delta V_r$, $\Delta\phi$, $\Delta\Delta\phi_r$, H, $\Delta H_r$, $\Delta\theta$, $\Delta\Delta\theta_r$, are 1, 2, 3, 4, 5, 6, 7, 8, respectively, and $\epsilon_x$, $\epsilon_y$ are 1, 2, respectively.

TABLE 6-9

Rule matrix ${}_1^{1,2}RM$ relating vertical deviation (V) and relative change in vertical deviation ($\Delta V_r$) to $\Delta\epsilon_x$.

| ${}_1^{1,2}RM$ | | (V) | | | | |
|---|---|---|---|---|---|---|
| | [$\Delta\varepsilon_x$] | VL | LO | RO | HI | VH |
| | NB\| | BH | BH | BH | BS | LA |
| | NS\| | BH | BH | BS | LA | DS |
| ($\Delta V_r$) | ZE\| | BH | BS | LA | DS | DH |
| | PS\| | BS | LA | DS | DH | DH |
| | PB\| | LA | DS | DH | DH | DH |

TABLE 6-10

Rule matrix ${}_{1}^{3,4}$RM relating inclinational deviation ($\Delta\phi$) and relative change in inclinational deviation ($\Delta\Delta\phi_r$) to $\Delta\epsilon_x$.

| ${}_{1}^{3,4}$RM | | ($\Delta\phi$) | | | | |
|---|---|---|---|---|---|---|
| | [$\Delta\epsilon_x$] | NB | NS | ZE | PS | PB |
| | NB\| | BH | BH | BH | BS | LA |
| | NS\| | BH | BH | BS | LA | DS |
| ($\Delta\Delta\phi_r$) | ZE\| | BH | BS | LA | DS | DH |
| | PS\| | BS | LA | DS | DH | DH |
| | PB\| | LA | DS | DH | DH | DH |

TABLE 6-11

Rule matrix ${}_{2}^{5,6}$RM relating horizontal deviation (H) and relative change in horizontal deviation ($\Delta H_r$) to $\Delta\epsilon_y$.

| ${}_{2}^{5,6}$RM | | (H) | | | | |
|---|---|---|---|---|---|---|
| | [$\Delta\epsilon_y$] | FL | LE | RO | RI | FR |
| | NB\| | RH | RH | RH | RS | LA |
| | NS\| | RH | RH | RS | LA | LS |
| ($\Delta H_r$) | ZE\| | RH | RS | LA | LS | LH |
| | PS\| | RS | LA | LS | LH | LH |
| | PB\| | LA | LS | LH | LH | LH |

TABLE 6-12

Rule matrix ${}_{2}^{7,8}$RM relating azimuthal deviation ($\Delta\theta$) and relative change in azimuthal deviation ($\Delta\Delta\theta_r$) into $\Delta\epsilon_y$.

| ${}_{2}^{7,8}$RM | | ($\Delta\theta$) | | | | |
|---|---|---|---|---|---|---|
| | [$\Delta\epsilon_y$] | NB | NS | ZE | PS | PB |
| | NB\| | RH | RH | RH | RS | LA |
| | NS\| | RH | RH | RS | LA | LS |
| ($\Delta\Delta\theta_r$) | ZE\| | RH | RS | LA | LS | LH |
| | PS\| | RS | LA | LS | LH | LH |
| | PB\| | LA | LS | LH | LH | LH |

To further clarify the NCU rules, further discussion is necessary. Each "cell" in ${}_{k}^{m,n}$RM is a of the form "if <> is [], AND <> is [], then <> should be []." One may choose to designate a particular rule as ${}_{k}^{m,n}\mathrm{RM}_{i,j}$ where (i,j) is the typical (row, column) delineation. More expressly, the rules comprise an antecedent portion which describes a condition to be judged and a consequent part which describes an operation to be formed to the degree that the condition is satisfactory.

Collectively, the rules (and fuzzy logic) act to quantify and systematize the decision making process, which a directional driller does subjectively based on past experience and "know how". Every ${}_{k}^{m,n}\mathrm{RM}_{i,j}$ can be expressed in terms of natural language, of which most every experienced drilling engineers around the world could understand. For example, the following is a representation of three different rules used in the NCU.

Rule A:

$${}_{1}^{1,2}RM_{3,2}$$

If <Vertical Deviation > is [Low],

AND <Relative Change in Vertical Deviation > is [Zero],

Then <Change in x-Eccentricity > should be [Build Soft].

Figure 11:
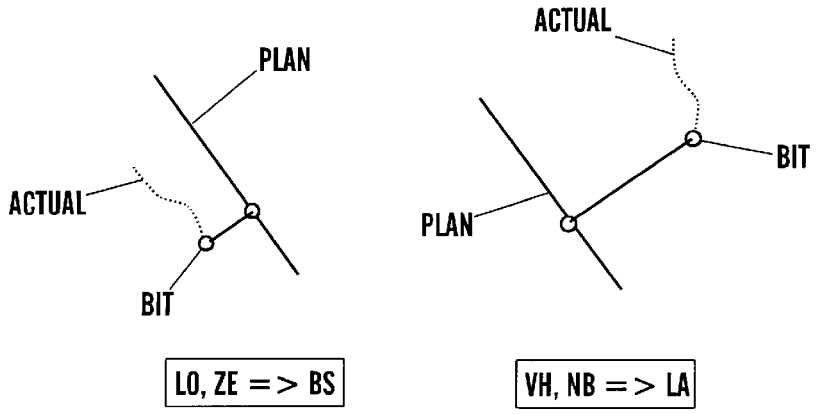
FIG. 11 are sketches depicting the scenario addressed by an IF . . . THEN rule related to vertical deviation, change in vertical deviation and consequential change in x-eccentricity.

In simple terms, rule A addresses the following scenario:

The actual hole path is lower than the desired hole path. Over the last $\Delta L$ feet of drilled hole, the status of being low has pretty much stayed the same. Since we are 'below the curve,' the hole inclination needs to be increased. Increasing the value of $\epsilon_x$ tends to increase the force at the bit in the direction which often acts to build hole angle. Since the vertical deviation is not too big, we do not want to make any drastic changes which may cause an unnecessary dogleg, or worse yet, overshoot the planned path. Therefore, let us increase the x-eccentricity by a smidge and see if that gets the actual hole path moving towards the planned hole path a little better. A visual illustration of rule A may be seen in FIG. 11.

Rule B: ${}_{1}^{1,2}\mathrm{RM}_{1,5}$

If <Vertical Deviation > is [Very High],

AND <Relative Change in Vertical Deviation > is [Negative Big],

Then <Change in x-Eccentricity > should be [Leave Alone].

In lay terms, rule B addresses the following scenario:

Right now we are way high of the curve. Since we are headed in the right direction, however, for now let's just leave the stabilizer settings alone. We'll keep an eye on it. A visual representation of Rule B may be seen in FIG. 6–13.

Rule C: ${}_{1}^{1,2}\mathrm{RM}_{1,5}$

If <Inclinational Deviation > is [Positive Small],

AND <Relative Change in Inclinational Deviation > is [Positive Small],

Then <Change in x-Eccentricity > should be [Drop Hard ].

In lay terms, rule C addresses the following scenario:

The hole inclination is a little higher than we'd like it to be. The bad thing is it's getting worse. We better try to drop angle pretty hard before it gets out of hand. We may not be able to get it back to what we want right away, but at least we can try to stop it from getting worse. Let's lower the x-eccentricity a good chunk and wait and see if that does the trick.

Thus, in a fraction of one second using the NCU, 100 scenarios are evaluated; i.e., 100 rules are computed ("fired") which act to decide how $\epsilon_x$ and $\epsilon_y$ should be changed. More details are necessary to understand just how crisp outputs are calculated with the NCU.

Table 6–8 shown below presents groupings of inputs and outputs used by the NCU. These groupings are also reflected in the rule matrices.

TABLE 6-8

| | | | | | |
|---|---|---|---|---|---|
| 1) V<br>2) $\Delta V_r$ | lineal ⇒ | ⇒ 1) $\Delta\varepsilon_x$ | 5) H<br>6) $\Delta H_r$ | lineal ⇒ | ⇒ 2) $\Delta\varepsilon_y$ |
| 3) $\Delta\phi$<br>4) $\Delta\Delta\phi_r$ | angular⇒ | | 7) $\Delta\theta$<br>8) $\Delta\Delta\theta_r$ | angular⇒ | |

For example, and as shown above in Table 6–8, V and $\Delta V_r$ act to suggest how $\epsilon_x$ should be adjusted, as do $\Delta\phi$ and $\Delta\Delta\theta_r$. This structure results from the idea that two different engineering concepts are being addressed to mathematically describe deviation: one is from lineal deviation, while the other is from angular deviation. For example, V and $\Delta V_r$ address where the actual hole exists in space relative to the plan, with indirect regard to angular orientation discrepancies. On the other hand, $\Delta\phi$and $\Delta\Delta\phi_r$ are concerned only with angular orientation deviations. A significant "breakthrough" in the design of the fuzzy controller is the identification and realization of lineal and angular deviations, (and the relative changes thereof,) as the NCU inputs. For example, with regard to how $\Delta\epsilon_x$ should be controlled, the rules from V and $\Delta V_r$ alone often are insufficient for consistent smooth performance controller. Thus, inclusion of the rules from $\Delta\phi$ and $\Delta\Delta\phi_r$ is essential.

Rules that address the same output, but which are based on the same engineering concept, are evaluated with fuzzy OR operators commonly known by those skilled in the art. For example, four rules within ${}_1^{1,2}RM$ indicate how the output fuzzy set Drop Soft (DS) should be scaled. Thus, the scaling factor for DS, from ${}_1^{1,2}RM$ , is the maximum DOM of ${}_1^{1,2}RM_{2,5}$, ${}_1^{1,2}RM_{3,4}$, ${}_1^{1,2}RM_{4,3}$, and ${}_1^{1,2}RM_{5,2}$.

Rules that address the same output, but which are based on separate engineering concepts, are evaluated or combined with the use of weighting factors. For example, ${}_1^{1,2}RM$ and ${}_1^{3,4}RM$ both address $\Delta\epsilon_x$, but come from the previously discussed lineal and angular ideas. The result of computing ${}_k^{m,n}RM$ is a vector of output fuzzy set scaling factors ${}_k^{m,n}RM_s$. To arrive at the final vector of output fuzzy set scaling factors ${}_kS$, with which a crisp output is computed in the defuzzification process, the following weighting methodology was employed.

$${}_1S_i={}_1^{1,2}s_i(1-WF)+{}_1^{3,4}s_iWF \qquad \text{[Eq. 1-21]}$$

$${}_2S_i={}_2^{5,6}s_i(1-WF)+{}_2^{7,8}s_iWF \qquad \text{[Eq. 1-22]}$$

where

WF=weighting factor; fraction i=1, 2, . . . , 5

Choosing the value of WF is application specific since tolerances to deviations vary. The closer the hole gets to being in the payzone, the more important becomes both concepts (lineal and angular). At hole depths far from the payzone, minimizing angular deviations is usually more critical than minimizing lineal deviations.

While WF may simply be specified, this could create a weak link in an automated system, if WF is poorly chosen. Accordingly, a second plurality of rules were developed by which to calculate $WF_x$ and $WF_y$, based on selected predefined inputs. Thus, computing crisp $WF_x$, for example, is an intermediate fuzzy-inference necessary to obtain a crisp $\Delta E_x$.

V and $\Delta\phi$ are used to fuzzy-infer $WF_x$. H and $\Delta\theta$ are used to fuzzy-infer $WF_x$. By definition, the weighting factor must be between 0 and 1. Thus, the second plurality of rules and fuzzy-inference provides for adaptive weighting factors.

As previously discussed, rule firing and the use of the weighting factor result in a vector of output fuzzy set scaling factors, ${}_kS$, with which a crisp, actual quantitative output is computed. The final computations performed by the NCU are the defuzzification of the (scaled) output fuzzy sets of $\Delta\epsilon_x$ and $\Delta\epsilon_y$. Defuzzification is performed with the centroid method, which means that for each output, the respective scaled fuzzy sets are mathematically added to produce a single function defined over the domain of the output. The centroid of the area defined by the foregoing function is the crisp output.

Consider a crisp NCU output variable y which belongs to the domain Y. The DOM functions of Y were given in [Eq. 1-15] through [Eq. 1-19]. Let $S_i$ represent the vector of scaling factors of the five fuzzy sets which describe Y, and whose notions are ($N_1$, $N_2$, $N_3$, $N_4$, $NA_5$). Defuzzification of Y to find $Y_{crisp}$ is computed as follows.

$$y_{crisp}=\frac{\int_{y_{min}}^{y_{max}}\left(\left(\sum_{i=1}^{5}S_i\mu_Y^{N_i}(y)\right)y\right)dy}{\int_{y_{min}}^{y_{max}}\left(\sum_{i=1}^{5}S_i\mu_Y^{N_i}(y)\right)dy} \qquad \text{[Eq. 1-23]}$$

-continued $$y_{crisp} = \frac{\int_{y_{min}}^{y_{max}} \left( \frac{S_1 y}{1+\exp\left(\frac{y-(\Delta-df_1\sigma)}{sf_1\sigma}\right)} + \frac{S_2 y}{1+\left(\frac{y-(\Delta-df_2\sigma)}{sf_2\sigma}\right)^2} + \frac{S_3 y}{1+\left(\frac{y-(\Delta-df_3\sigma)}{sf_3\sigma}\right)^2} + \frac{S_4 y}{1+\left(\frac{y-(\Delta+df_4\sigma)}{sf_4\sigma}\right)^2} + \frac{S_5 y}{1+\exp\left(\frac{-y+(\Delta+df_5\sigma)}{sf_5\sigma}\right)} \right) dy}{\int_{y_{min}}^{y_{max}} \left( \frac{S_1}{1+\exp\left(\frac{y-(\Delta-df_1\sigma)}{sf_1\sigma}\right)} + \frac{S_2}{1+\left(\frac{y-(\Delta-df_2\sigma)}{sf_2\sigma}\right)^2} + \frac{S_3}{1+\left(\frac{y-(\Delta-df_3\sigma)}{sf_3\sigma}\right)^2} + \frac{S_4}{1+\left(\frac{y-(\Delta+df_4\sigma)}{sf_4\sigma}\right)^2} + \frac{S_5}{1+\exp\left(\frac{-y+(\Delta+df_5\sigma)}{sf_5\sigma}\right)} \right) dy}$$

Each term in [Eq. 1-23] may be integrated separately and then combined when the integrand limits are applied. The symbolic integration of each term in [Eq. 1-23] is elementary, except those from $$S_1 y \mu_Y^{N_1}(y) \text{ and } S_5 y \mu_Y^{N_5}(y)$$

found in the numerator. The closed form integral of either $$S_1 y \mu_Y^{N_1}(y) \text{ or } S_5 y \mu_Y^{N_5}(y)$$

requires the use of a function known as the dilogarithm. The dilogarithm function, which to compute must be numerically integrated, is given below.

$$DILOG(x) = \int_1^x \frac{\ln(t)}{1-t} dt \qquad \text{[Eq. 1-24]}$$

The NCU employs five-point Gauss-Legendre numerical integration to compute [Eq. 1-24]. Alternatively, it may be advantageous to simply compute $Y_{crisp}$ entirely with numerical integration instead of with analytical integration and numerical integration.

Example Calculation of the NCU

The preceding discussion presented an overview of the mathematics and methodology of the NCU, including the process of mapping inputs into outputs. A numerical example of processing the NCU is now presented to provide additional information regarding how the NCU may be used in practice. Thus, the following is an example of how to calculate a new $\epsilon_x$. As such, consider the following case of computing a new $\epsilon_x$. The NCU is processed after drilling 30 feet from the last time it was processed. The control variables for the example calculation are shown below.

$\Delta L = 30$ ft $\quad \phi_p^* = 45$ deg at $n$ and at $n-1$ $V^{n-1} = 12$ ft $\quad V^n = 11.6$ ft $\phi_b^{n-1} = 44.6$ deg $\quad \phi_b^n = 44.3$ deg -continued $WF = 50\%$ $\quad \varepsilon_x^n = 0.5$ mm Intermediate calculations.

$$\Delta\phi^{n-1} = \phi_b^{n-1} - \phi_p^* = 44.6 - 45 = -0.4 \text{ deg}$$

$$\Delta\phi^n = \phi_b^n - \phi_p^* = 45 - 45.7 = -0.7 \text{ deg}$$

Thus, the four NCU inputs with which to compute a new $\Delta\epsilon_x$ are $$V = 11.6 \text{ ft} \quad \Delta V_r = \frac{V^n - V^{n-1}}{\Delta L} = \frac{11.6-12}{30} = -0.0133$$

$$\Delta\phi = -0.7 \text{ deg}$$

$$\Delta\Delta\phi_r^n = \frac{\Delta\phi^n - \Delta\phi^{n-1}}{\Delta L} = \frac{-0.7-(0.4)}{30} = -0.010 \text{ deg/ft.}$$

Fuzzify the NCU inputs by computing the DOMs of each crisp input with their respective fuzzy sets. (See [Eq. 1-9]–[Eq. 1-14])

V→(VL, LO, RO, HI, VH)→(0, 0, 0, 0, 1.00)

$\Delta V_r$→(NB, NS, ZE, PS, PB)→(0.65, 0.26, 0, 0, 0)

$\Delta\phi$→(NB, NS, ZE, PS, PB)→(0.33,0.84, 0, 0, 0)

$\Delta\phi_r$→(NB, NS, ZE, PS, PB)→(0-81, 0.1 1, 0, 0, 0)

Fire the rules in ${}_1^{1,2}$RM.

TABLE 6-13

| ${}_1^{1,2}$RM | (V) | 0 | 0 | 0 | 0 | 1.00 |
|---|---|---|---|---|---|---|
| ($\Delta V_R$) | [$\Delta\varepsilon_X$] | VL | LO | RO | HI | VH |
| 0.65 | NB\| | BH | BH | BH | BS | LA |
| 0.26 | NS\| | BH | BH | BS | LA | DS |
| 0 | ZE\| | BH | BS | LA | DS | DH |
| 0 | PS\| | BS | LA | DS | DH | DH |
| 0 | PB\| | LA | DS | DH | DH | DH |

TABLE 6-14

| ${}^{1,2}_{1}RM$ | | (V) | | | | |
|---|---|---|---|---|---|---|
| | $[\Delta\varepsilon_X]$ | VL | LO | RO | HI | VH |
| | NBl | 0 | 0 | 0 | 0 | LA |
| | NSl | 0 | 0 | 0 | 0 | DS |
| $(\Delta V_R)$ | ZEl | 0 | 0 | 0 | 0 | DH |
| | PSl | 0 | 0 | 0 | 0 | DH |
| | PBl | 0 | 0 | 0 | 0 | DH |

Fire the rules in ${}_{1}^{3,4}RM$.

TABLE 6-15

| ${}^{3,4}_{1}RM$ | $(\Delta\phi)$ | 0.33 | 0.84 | 0 | 0 | 0 |
|---|---|---|---|---|---|---|
| $(\Delta\Delta\phi_R)$ | $[\Delta\varepsilon_X]$ | NB | NS | ZE | PS | PB |
| 0.81 | NBl | BH | BH | BH | BS | LA |
| 0.11 | NSl | BH | BH | BS | LA | DS |
| 0 | ZEl | BH | BS | LA | DS | DH |
| 0 | PSl | BS | LA | DS | DH | DH |
| 0 | PBl | LA | DS | DH | DH | DH |

TABLE 6-16

| ${}^{3,4}_{1}RM$ | | $(\Delta\phi)$ | | | | |
|---|---|---|---|---|---|---|
| | $[\Delta\varepsilon_X]$ | NB | NS | ZE | PS | PB |
| | NBl | 0.33 | 0.81 | 0 | 0 | 0 |
| | NSl | 0.11 | 0.11 | 0 | 0 | 0 |
| $(\Delta\Delta\phi_R)$ | ZEl | 0 | 0 | 0 | 0 | 0 |
| | PSl | 0 | 0 | 0 | 0 | 0 |
| | PBl | 0 | 0 | 0 | 0 | 0 |

Find the scaling factors ${}_{1}^{1,2}s_i$ from ${}_{1}^{1,2}RM$.

$$ {}^{1,2}_{1}s_1 = {}^{1,2}_{1}s_{DH} = 0 $$
$$ {}^{1,2}_{1}s_2 = {}^{1,2}_{1}s_{DS} = 0.26 $$
$$ {}^{1,2}_{1}S_3 = {}^{1,2}_{1}s_{LA} = 0.65 $$
$$ {}^{1,2}_{1}s_4 = {}^{1,2}_{1}s_{BS} = 0 $$
$$ {}^{1,2}_{1}s_5 = {}^{1,2}_{1}s_{BH} = 0 $$

Find the scaling factors ${}_{1}^{3,4}s_i$ from ${}_{1}^{3,4}RM$.

$$ {}^{3,4}_{1}s_1 = {}^{3,4}_{1}s_{DH} = 0 $$
$$ {}^{3,4}_{1}s_2 = {}^{3,4}_{1}s_{DS} = 0 $$
$$ {}^{3,4}_{1}s_3 = {}^{3,4}_{1}s_{LA} = 0 $$
$$ {}^{1,2}_{1}s_5 = {}^{1,2}_{1}s_{BH} = \max(0.33, 0.81, 0.11) = 0.81 $$

With WF specified, the final output fuzzy set scaling factors are computed, ${}_{1}S_i$.

$$ {}_{1}S_1 = {}^{1,2}_{1}s_1(1 - WF) + {}^{3,4}_{1}s_1 WF = (0)(1 - 0.5) + (0)(0.5) = 0 $$
$$ {}_{1}S_2 = {}^{1,2}_{1}s_2(1 - WF) + {}^{3,4}_{1}s_2 WF = (0.26)(1 - 0.5) + (0)(0.5) = 0.13 $$
$$ {}_{1}S_3 = {}^{1,2}_{1}s_3(1 - WF) + {}^{3,4}_{1}s_3 WF = (0.65)(1 - 0.5) + (0)(0.5) = 0.33 $$
$$ {}_{1}S_4 = {}^{1,2}_{1}s_4(1 - WF) + {}^{3,4}_{1}s_4 WF = (0)(1 - 0.5) + (0)(0.5) = 0 $$
$$ {}_{1}S_5 = {}^{1,2}_{1}s_5(1 - WF) + {}^{3,4}_{1}s_5 WF = (0)(1 - 0.5) + (0.81)(0.5) = 0.41 $$

Figure 12:
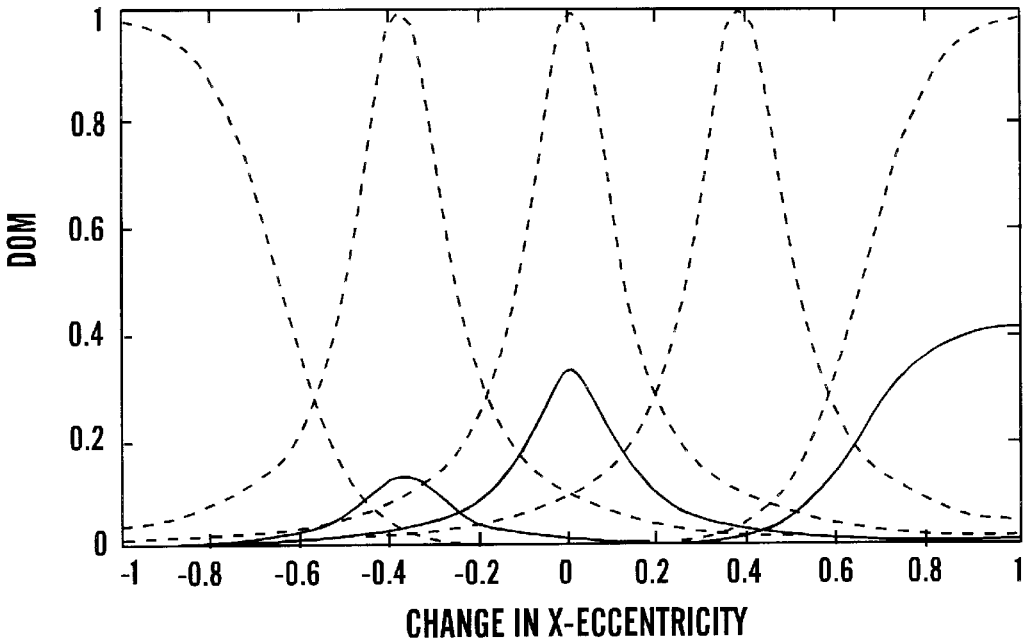
FIG. 12 is a graph identifying the original (dashed lines) and scaled (solid lines) fuzzy sets of the x-eccentricity settings of the downhole tool having resulted from fuzzy-computing the IF . . . THEN rules.
Figure 13:
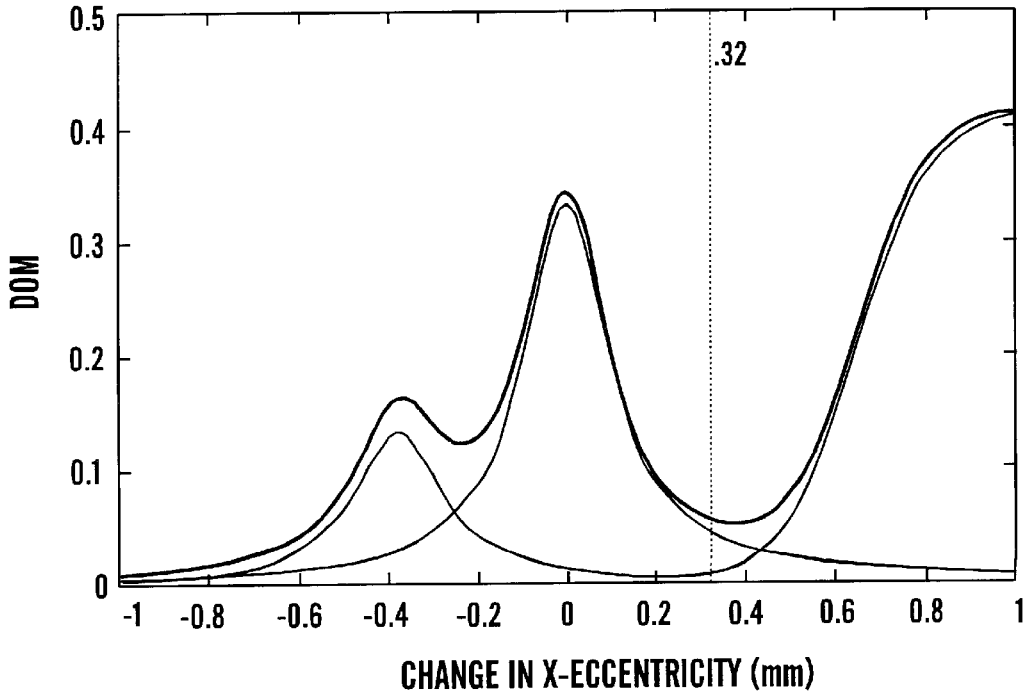
FIG. 13 is a graph of a function adding the scaled fuzzy sets to compute the actual change in x-eccentricity setting of the downhole adjustable tool.

A graph of the original and scaled NCU output fuzzy sets of $\Delta\epsilon_x$ are presented in FIG. 12. The crisp value of $\Delta\epsilon_x$ is found by mathematically adding the scaled output fuzzy sets thereby producing a single function respective to the domain. The centroid of the area below the function is $\Delta\epsilon_x$, as shown in FIG. 13. Accordingly, with the appropriate values substituted in [Eq. 1-23], $\Delta\epsilon_x$ is $$ \Delta\varepsilon_x = \frac{\int_{-1}^{1}\left(\frac{0.13y}{1+\left(\frac{y-(-3.8\times 0.1)}{1.2\times 0.1}\right)^2} + \frac{0.33y}{1+\left(\frac{y}{1.2\times 0.1}\right)^2} + \frac{0.41y}{1+\exp\left(\frac{-y+(6.5\times 0.1)}{0.8\times 0.1}\right)}\right)dy}{\int_{-1}^{1}\left(\frac{0.13y}{1+\left(\frac{y-(-3.8\times 0.1)}{1.2\times 0.1}\right)^2} + \frac{0.33y}{1+\left(\frac{y}{1.2\times 0.1}\right)^2} + \frac{0.41y}{1+\exp\left(\frac{-y+(6.5\times 0.1)}{0.8\times 0.1}\right)}\right)dy} = 0.32 \text{ mm} $$

The value of $\Delta\epsilon_x$ was numerically computed to be 0.32 millimeters for this example. If the NCU is forced to round $\Delta\epsilon_x$ to the nearest one-tenth of a millimeter, then for this example the new x-eccentricity settings are $$\varepsilon_x^n + \Delta\varepsilon_x = 0.5 + 0.3 = 0.8 \text{ mm.}$$

The NCU as presented herein was cod ed such that its performance with a directional drilling simulator could be investigated. A screen capture of the NCU screen is presented in FIG. 14. The case shown in FIG. 14 replicates the example calculation just discussed.

It is noted that the number of fuzzy sets chosen to describe the domain of a variable need not equal five, as thus far detailed herein. For example, nine fuzzy sets could be chosen to do such, and the mathematics adjusted accordingly. This alteration does have a substantial effect on the total number of rules. See FIG. 16 for an example alternative rule matrix and compare it with FIGS. 6–9. Additionally, and provided for reference, FIG. 17 presents a 9×9 rule matrix used to determine $WF_x$ adaptively, as discussed earlier.

Figure 18:
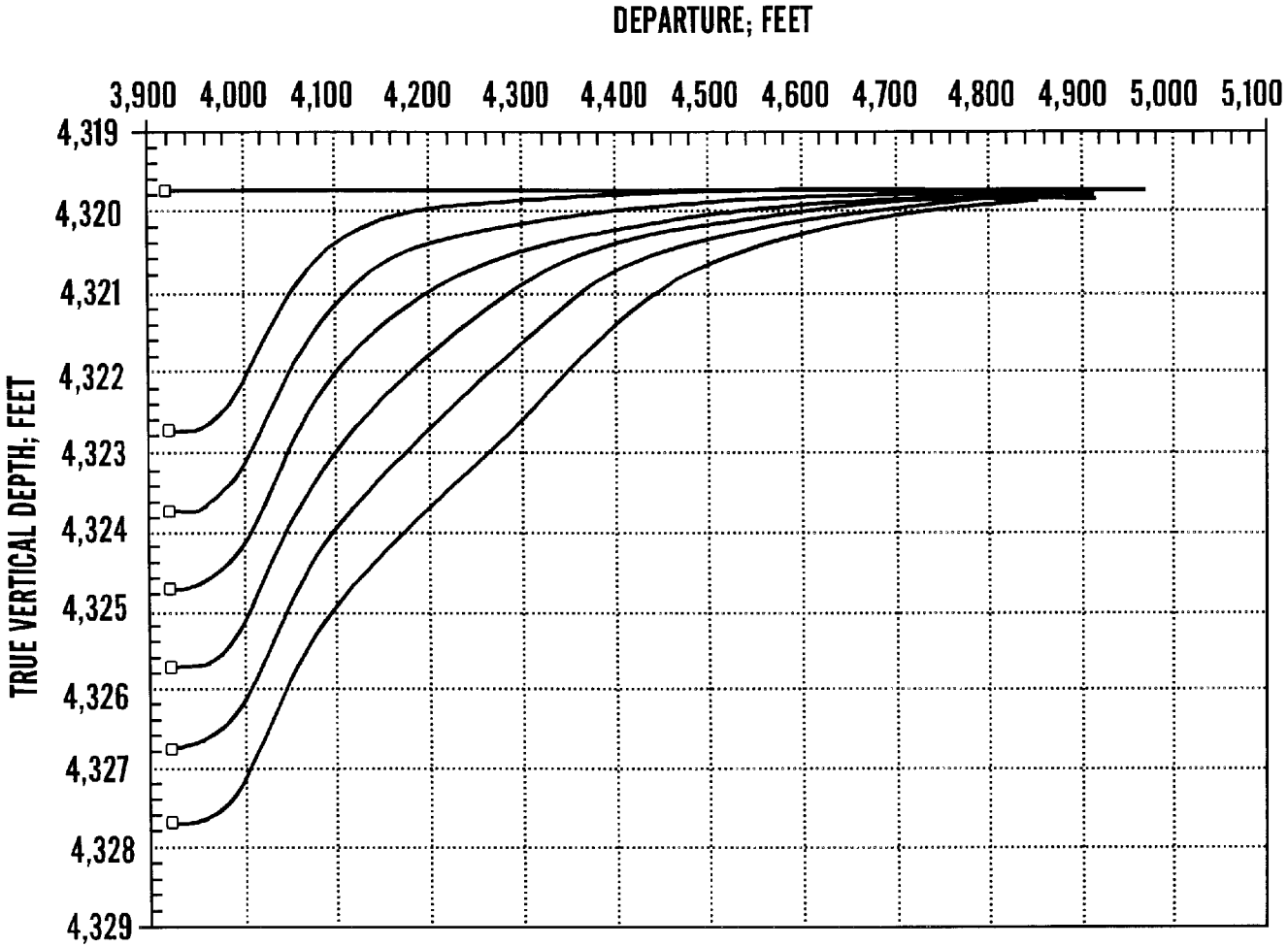
FIG. 18 is a section view of six computer simulated wellbores that used the NCU.

FIG. 18 presents a section view of six computer-simulated wellbores, in which the overall simulation idea is a true vertical depth correction from an initial low starting point. The simulated wellbore paths are all smooth and exhibit no overshoot-undershoot characteristics when approaching the target horizontal path. The foregoing properties are extremely favorable in directional drilling. However, of most significance is the following. In each of the six simulations, the NCU comprised identical control parameters, although, the initial conditions for each are different. This may appear trivial, however, the implications are that the performance of the NCU is quite general. Never in the prior art has the aforementioned been shown; rather, the same initial conditions are employed and the control parameters are altered to show how sensitive the subsequent simulated path becomes based on the chosen parameter values. In all cases, if the "wrong" control parameter (the number of which has not exceeded two) values are selected, large fluctuations and or disastrous instability results. Automated directional drilling systems of the future will require a numberical control unit whose performance is general, else automation will not be adopted.

Figure 19:
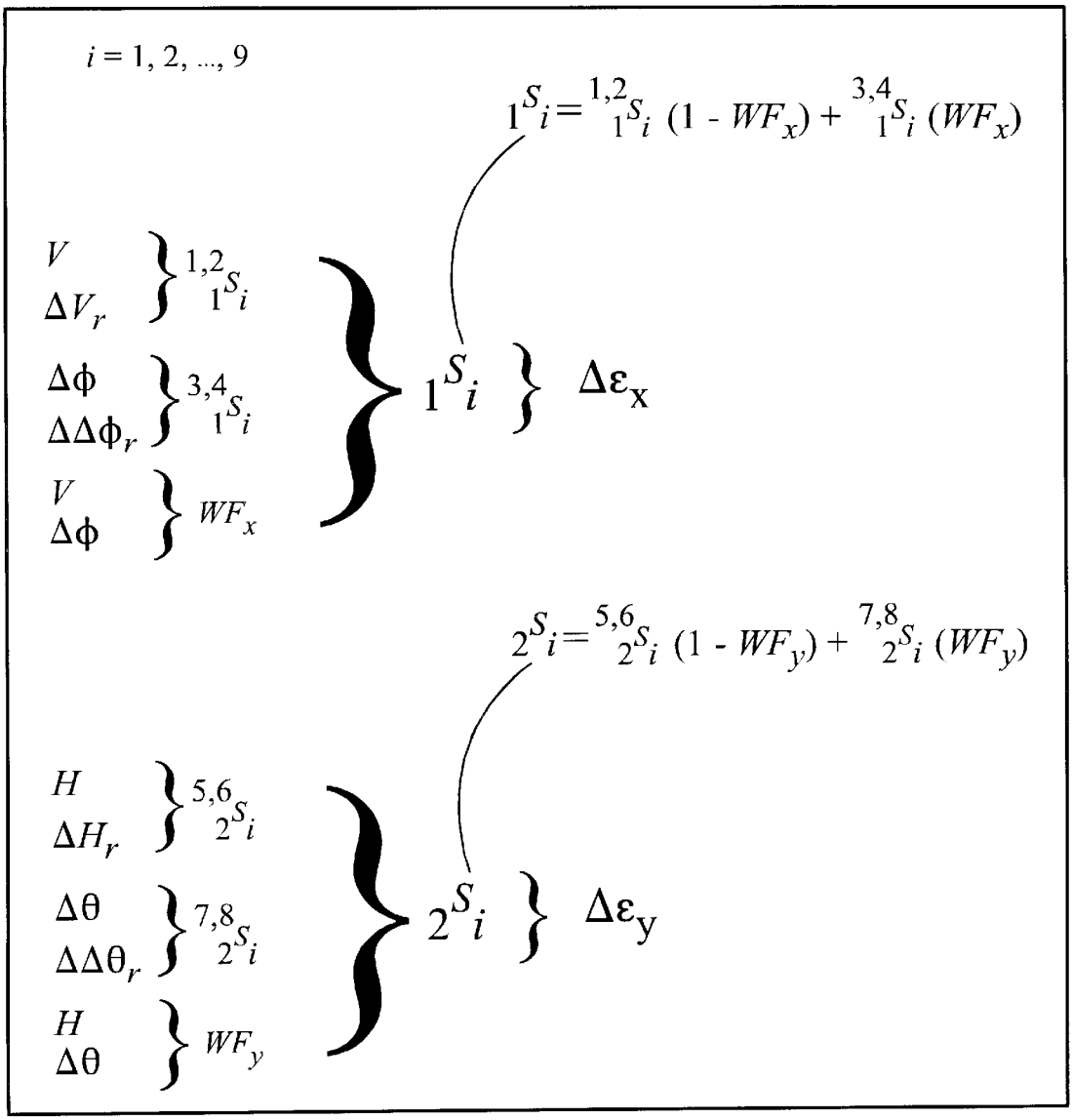
FIG. 19 is a summary of how the inputs and outputs of the NCU are interrelated and processed.

FIG. 19 presents a summary of how the inputs and outputs of the NCU are interelated and processed.

For terminology and clarity purposes, acknowledge the following. A 'knowledge storage section' basically is comprised of:

(a) Degree-of-membership functions (i.e., fuzzy sets) representing the meanings of notions about "input" and "output" variables;

(b) physical domains over which the degree-of-membership functions apply (c) a choice of shape or pattern of degree-of-membership functions (d) a fuzzification module which performs the so-called fuzzification which converts a current actual (crisp) value of a process state variable int a fuzzy set, in order to make it compatible with the fuzzy set representation of the process variable in the rule-antecedent.

(e) a rule base, which represents in a structured way the control policy of an experienced process operator and or control engineer in the form of a set of production rules such as: IF [process state] THEN [control output]:

i.) wherein the IF part is called the rule-antecedent and is description of a process state in terms of a logical combination of fuzzy comparisons;

ii.) wherein the THEN part is called the rule-consequent and is again a description of the control output in terms of logical combinations of fuzzy control actions to be performed (propositions);

iii.) wherein these propositions state the notions which the control output variables take whenever the current process state matches (at least to a certain degree) the process state description in the rule-antecedent;

iv.) wherein the design methodology involved in the construction of the rule base includes:

A. choice of process state and control ouput variables;

B. choice of the contents of the rule-antecedent and rule-consequent;

C. choice of notions for the process state and control output variables;

D. Derivation and or definition of the set of rules.

An "inferring section" basically functions to compute the overall value of the control ouptut variable based on the individual contributions of each rule in the rule base. Each such individual contribution represents the values of the control output notion as computed by a single rule. The output of the fuzzification module, is matched to each rule-antecedent, and a degree of match for each rule is established. This degree of match represents the degree of satisfaction or "truthness" of the IF pat of the rule. Based on this degree of match, the value of the control ouput notion in the rule-antecedent is modified, i.e., the "scaled" fuzzy set representing the notion of the control output variable is determined. After necessary implementation of a weighting factor, the subsequent set of all scaled control output fuzzy sets of the matched rules represent the overall fuzzy value of the control ouput. A defuzzification module performs the so-called defuzzification which converts the set of modified control output fuzzy sets into a single point-wise (crisp) value.

While the invention has been described in combination with specific embodiments thereof, it is evident that many alternatives, modifications and variations will be apparent to those skilled in the art in light of the foregoing description. Accordingly, it is intended to embrace all such alternatives, modifications, and variations as fall within the spirit and scope of the claims.

What is claimed is:

1. A numerical control unit adapted for determining a change in positional settings of a downhole tool for steering a bottomhole assembly used to drill a wellbore, comprising:

a knowledge storage section having a first plurality of rules in an IF . . . THEN format, said rules based on a current position and a preferred position of said wellbore;

an inferring section for determining an optimum new position of said downhole tool on the basis of a number of said rules stored in said knowledge storage section.

2. The numerical control unit of claim 1, wherein said first plurality of rules are based on mathematical difference of spatial properties identified between said current position and said preferred position of said wellbore.

3. The numerical control unit of claim 2, wherein said spatial properties include at least one input comprised of a linear based deviation component and/or an angular based deviation component determined from said current position and said preferred position of said wellbore.

4. The numerical control unit of claim 3, wherein said linear based deviation component comprises at least one of the following:

a linear deviation in a vertical sense, as computed relative to said preferred position and said current position of said wellbore;

a relative change in linear deviation in a vertical sense calculated by determining a past linear deviation in a vertical sense subtracted from a current linear deviation in a vertical sense, with a difference being divided by a measured distance of wellbore drilled between a first point of determination and a second point of determination;

a linear deviation in a horizontal sense, as computed relative to said preferred position and said current position of said wellbore, and orthogonal to said linear deviation in a vertical sense; and a relative change in linear deviation in a horizontal sense calculated by determining a past linear deviation in a horizontal sense subtracted from a current linear deviation in a horizontal sense, with a difference being divided by a measured distance of wellbore drilled between a first point of determination and a second point of determination.

5. The numerical control unit of claim 1, wherein said inference section comprises fuzzy logic means for inferring said preferred downhole tool position according to said first plurality of rules stored in said knowledge storage section, said rules comprising an antecedent part describing a condition to be judged and a consequent part describing an operation to be performed if said condition is satisfactory or unsatisfactory, said numerical control unit defining a preferred positional setting of said downhole tool.

6. The numerical control unit of claim 1, further comprising a second plurality of rules which determines a weighting factor based on a vertical deviation component and an inclinational deviation component of said current position and said preferred position of said wellbore to further optimize the said new positional setting of said downhole tool for steering said bottomhole assembly.

7. The numerical control unit of claim 1, further comprising signal means to provide a signal to said downhole tool at predetermined depth intervals to automatically adjust the new positional setting of said downhole tool, based on said inference of said first plurality of rules and deviatons calculated between said current position and said preferred position of said wellbore.

8. The numerical control unit of claim 1, wherein said current position of said wellbore is determined from wellbore survey data received at periodic intervals.

9. The numerical control unit of claim 1, wherein said downhole tool is any mechanical instrument located within said bottomhole assembly that has an adjustable component with positional settings.

10. The numerical control unit of claim 1, wherein said changes in positional settings of said downhole tool are determined by respective output components in at least two or more distinct directions.

11. The numerical control unit of claim 1, further comprising a second plurality of IF . . . THEN rules used to determine a weighting factor with which to weigh a consequential output component from said first plurality of IF . . . THEN rules, wherein said consequential output components are derived from a linear-based deviation component and an angular-based deviation component to further optimize the desired position of said downhole tool for steering a bottomhole assembly to drill said wellbore.

12. The numerical control unit of claim 11, wherein said weighting factor used to determine said consequential output component in a vertical sense is based on said linear deviation component in a vertical sense and said angular based deviation component in an inclinational direction.

13. The numerical control unit of claim 11, wherein the weighting factor used to determine said consequential output component is further based on a linear deviation component in a horizontal sense and an angular deviation component in an azimuthal direction.

14. A method adapted for controlling a positional setting of an adjustable downhole tool located within a bottomhole assembly used to drill a wellbore, comprising the steps of:

storing a first plurality of rules in an IF . . . THEN format in a knowledge storage section, said first plurality of rules defining a degree of movement of said adjustable downhole tool based on a current measured position of said wellbore and a preferred position of said wellbore;

receiving current wellbore survey data at periodic intervals to define the current position of said wellbore;

comparing said current wellbore position data with a preferred position of said wellbore; and inferring said current wellbore position data with said first plurality of rules to determine a preferred positional setting of said adjustable downhole tool to provide steering of said bottomhole assembly.

15. The method of claim 14, wherein said inferring step comprises fuzzy logic means for inferring said positional setting of said adjustable downhole tool according to said first plurality of rules, said rules comprising an antecedent part describing a condition to be judged and a consequent part describing an operation to be preferred if said condition is satisfactoy or unsatisfactory.

16. The method of claim 14, further comprising the step of storing a second plurality of rules with which to define a weighting factor for weighting an intermediate result of said inference step, said second plurality of rules including a linear deviation component and an angular deviation component.

17. The method of claim 16, further comprising fuzzy logic means for inference of said second plurality of rules, said rules comprising an antecedent part describing a condition to be judged and a consequent part describing a weighting factor value to be preferred if said condition is satisfactory or unsatisfactory.

18. The method of claim 14, further comprising signal means for substantially automatically providing input to adjust said downhole tool to said preferred position based on the fuzzy inference of said current and said preferred wellbore positional data and said first plurality of rules.

19. The method of claim 14, wherein at least one of said plurality of rules is based on a mechanical material property of said bottomhole assembly or a wellbore condition.

20. The method of claim 19, wherein said mechanical material property of said bottomhole assembly comprises at least one of the following:

a physical property of a drill bit used during the drilling of said wellbore;

a physical property of a stabilizer, a drill collar or another component used in a bottomhole assembly;

a magnitude of force acting on said drill bit; and a rate of rotation of said drill bit used during the drilling of said wellbore.

21. The method of claim 19, wherein said wellbore condition comprises at least one of the following parameters:

a geologic formation characteristic of a rock being drilled;

a property of a drilling fluid used during drilling;

a particular wellbore size and/or geometric shape;

a magnitude of a preferred inclination of said wellbore;

a magnitude of a preferred azimuth of said wellbore;

a rate of penetration of said drill bit; and a magnitude of specific operating conditions such as weight-on-bit or drill string rotation speed.

22. A method of determining an optimum position of a downhole tool in a wellbore to steer a bottomhole assembly to a target location using fuzzy logic, comprising the steps of:

a) storing a first plurality of rules in a production format, at least one of said rules defining a preferred position of said downhole tool based on a current position of said wellbore and a preferred position of said wellbore;

b) storing input degree of membership functions employed for fuzzy interference in a knowledge storage section; and c) performing fuzzy inference on said input degree of membership functions on the basis of a number of said stored rules to derive output degree of membership functions and deducing from said output degree of membership functions an optimum position of said adjustable downhole tool, wherein said bottomhole assembly can be steered to said target location.

23. The method of determining the optimum position of an adjustable downhole tool as set forth in claim 22, wherein said storing of said degree-of-membership functions comprises storing said functions in a predetermined or adaptive shape pattern.

24. The method of determining the optimum position of an adjustable downhole tool as set forth in claim 22, wherein another one or more of said rules defines a change to said tool positional setting based on a relative change in said spatial deviation of said current wellbore position and said preferred wellbore position, said deviations including a linear deviation component and an angular deviation component.

25. The method of determining the optimum position of downhole as set forth in claim 22, wherein said downhole tool is a mechanical instrument positioned in a bottomhole assembly that by design contains an adjustable positional setting that when altered either directly or indirectly affects the magnitude and direction of the forces acting at or near the drill bit.

26. The method of determining the optimum position of a downhole tool as set forth in claim 22, wherein said downhole tool is an adjustable stabilizer.

* * * * *